US007913990B2

(12) United States Patent
Nakamura et al.

(10) Patent No.: US 7,913,990 B2
(45) Date of Patent: Mar. 29, 2011

(54) IMAGE FORMING SYSTEM, IMAGE FORMING APPARATUS AND PROGRAM

(75) Inventors: Shoichi Nakamura, Hachioji (JP); Kenichi Hosoi, Kawaguchi (JP); Takaaki Sakai, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 930 days.

(21) Appl. No.: 11/259,393

(22) Filed: Oct. 26, 2005

(65) Prior Publication Data

US 2006/0120782 A1 Jun. 8, 2006

(30) Foreign Application Priority Data

Nov. 30, 2004 (JP) ..... 2004-345715
Aug. 19, 2005 (JP) ..... 2005-238518

(51) Int. Cl.
*B65H 33/04* (2006.01)
*B65H 39/00* (2006.01)

(52) U.S. Cl. ..... 270/58.11; 270/58.08; 270/58.09; 270/58.07

(58) Field of Classification Search ..... 270/58.07, 270/58.08, 58.09, 58.11
See application file for complete search history.

(56) References Cited

U.S. PATENT DOCUMENTS 6,296,247 B1 * 10/2001 Tamura et al. ..... 271/214
6,871,851 B2 3/2005 Tamura et al.
6,991,225 B2 * 1/2006 Miyake et al. ..... 270/58.09
2002/0190456 A1 * 12/2002 Miyake et al. ..... 270/58.08
2003/0052446 A1 3/2003 Endo et al.
2003/0219294 A1 * 11/2003 Yoshimura et al. ..... 399/408
2004/0208666 A1 10/2004 Kiyosumi et al.

FOREIGN PATENT DOCUMENTS

JP 10-181091 7/1998
JP 2001-048412 A 2/2001
JP 2001-220054 A 8/2001
JP 2001220054 A * 8/2001
JP 2001-341925 A 12/2001
JP 2001341925 A * 12/2001
JP 2002-179326 A 6/2002
JP 2003-002519 A 1/2003
JP 2003002519 A * 1/2003

OTHER PUBLICATIONS

Japanese Office Action (and English translation thereof) dated Nov. 25, 2008, issued in a counterpart Japanese Application.
Extended European Search Report dated Aug. 25, 2010 (in English) issued in counterpart European Application No. 05256612.2.

* cited by examiner

*Primary Examiner* — Gene Crawford
*Assistant Examiner* — Yolanda Cumbess
(74) *Attorney, Agent, or Firm* — Holtz, Holtz, Goodman & Chick, PC

(57) ABSTRACT

There is described an image forming system, which comprises an image forming apparatus to produce a printing material as one group of recording mediums or plural printing materials as plural groups of recording mediums from a single document set, and a finisher to apply a finish processing to said recording mediums, wherein the image forming system includes a controlling section to control so that, if a mixture mode is set, a non-finished recording medium and a finished recording medium within the single group are stacked at a same recording-medium stacking position on a stacking tray.

10 Claims, 15 Drawing Sheets

FIG. 4 ( a )
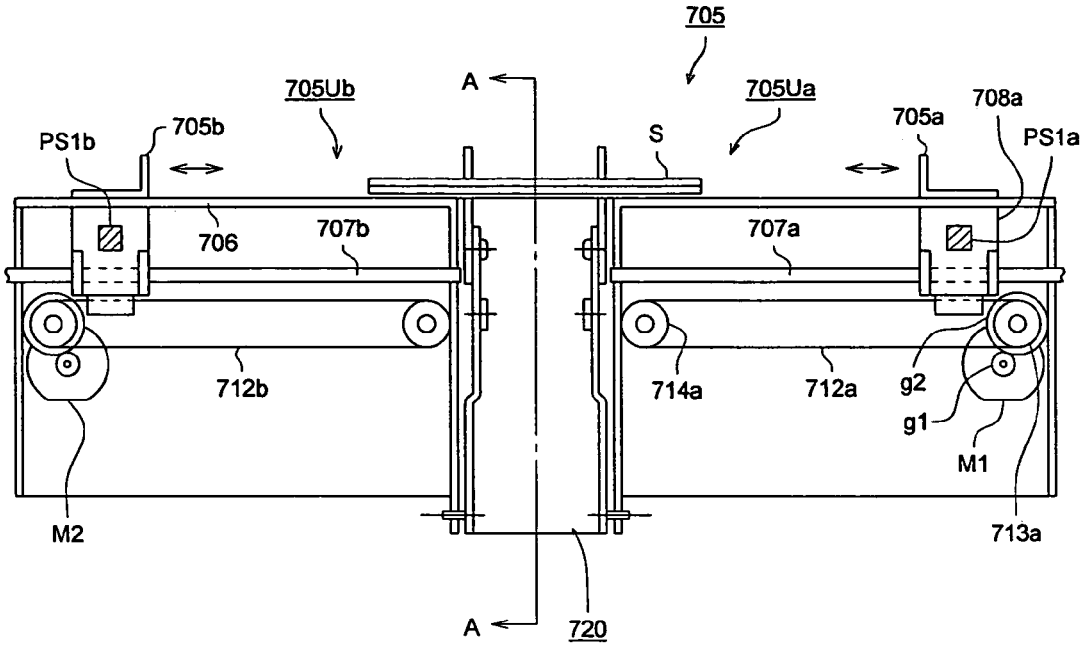
FIG. 4 ( b )
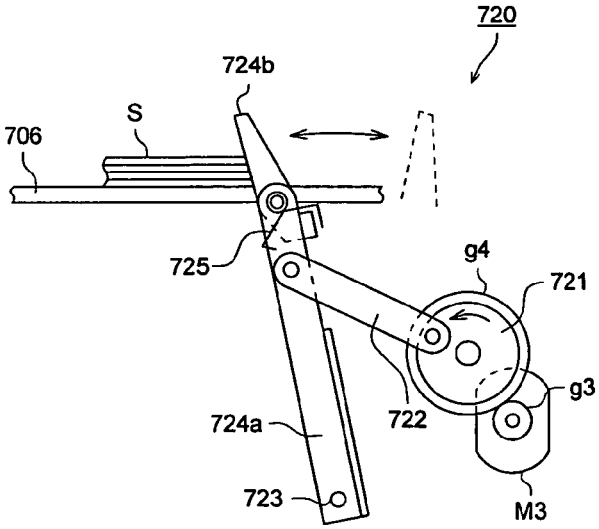
CROSS SECTION TAKEN ALONG THE LING A - A FIG. 6 ( a )
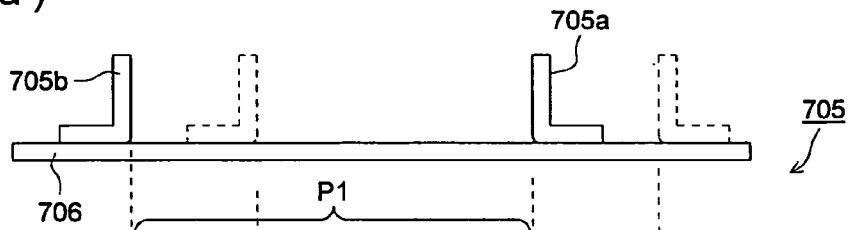
FIG. 6 ( b )
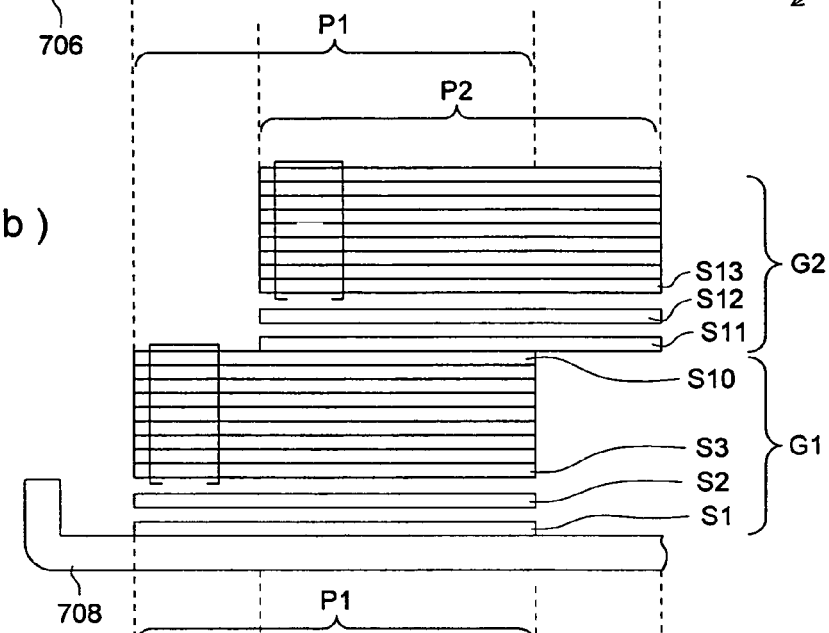
FIG. 6 ( c )
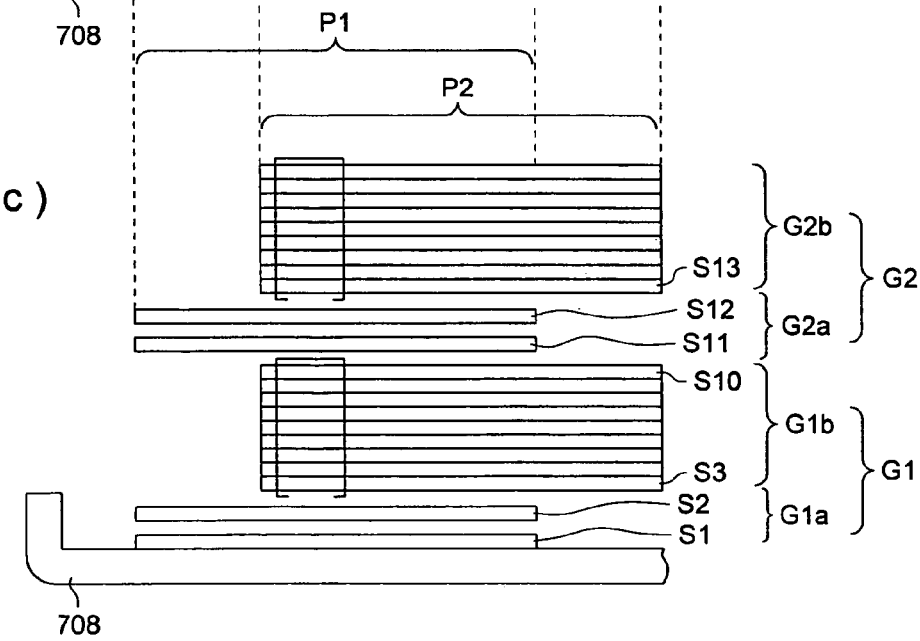

FIG. 12 ( a )
FIG. 12 ( b )
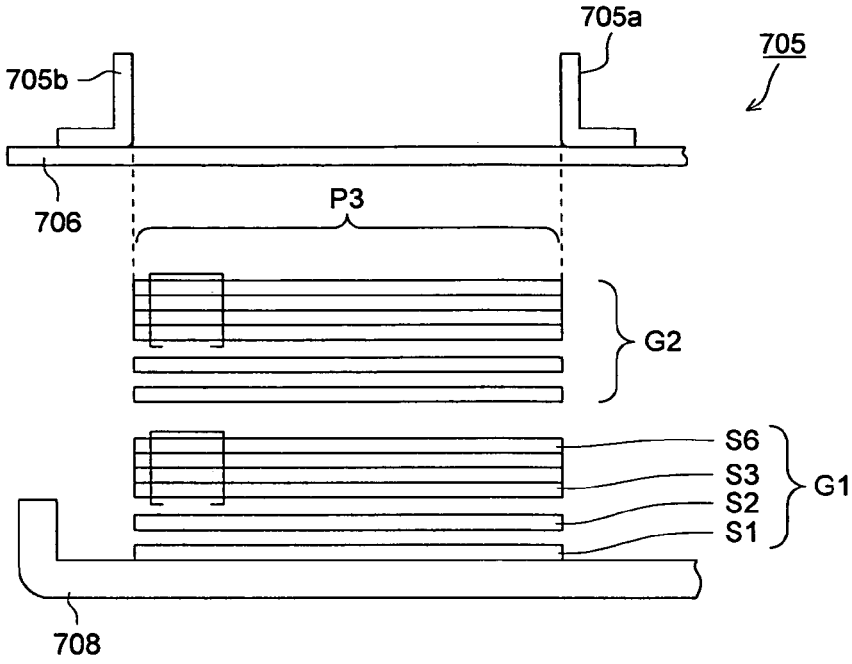

FIG. 13 ( a )
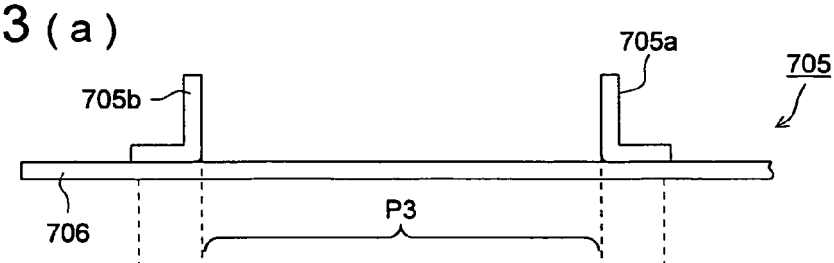
FIG. 13 ( b )
FIRST MODE
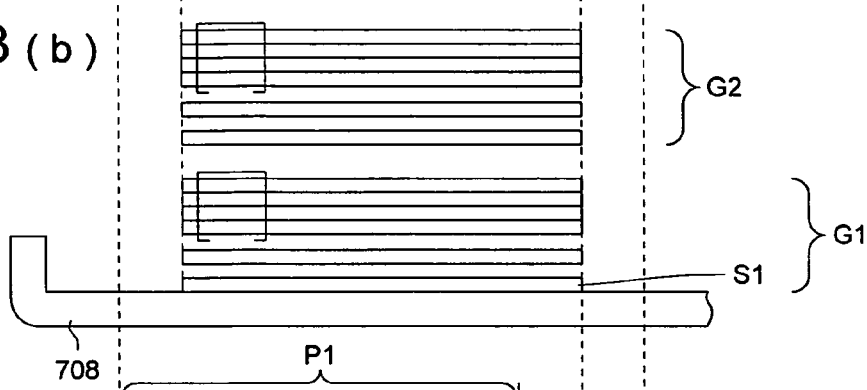
FIG. 13 ( c )
SECOND MODE
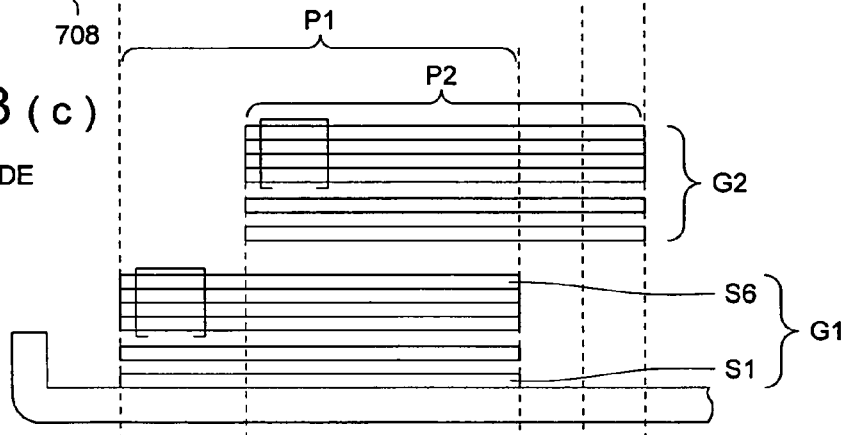
FIG. 13 ( d )
THIRD MODE
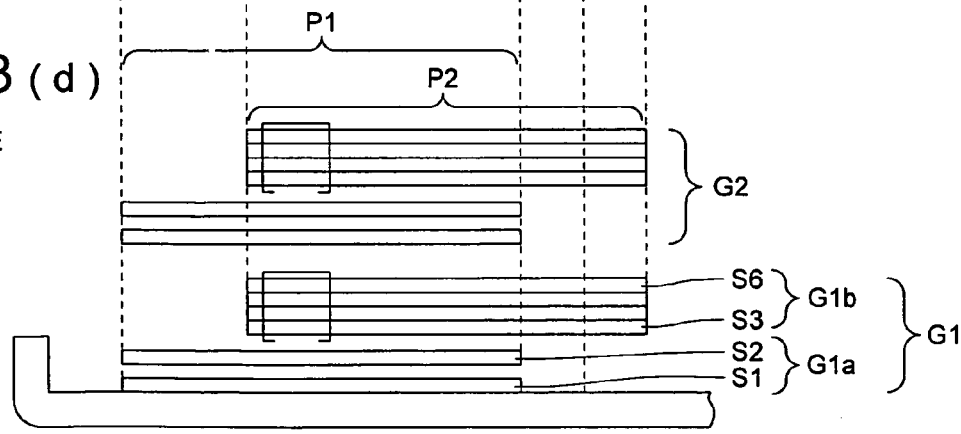

IMAGE FORMING SYSTEM, IMAGE FORMING APPARATUS AND PROGRAM

BACKGROUND OF THE INVENTION

The present invention relates to an image forming system, an image forming apparatus and a program, and more particularly, it relates to an image forming system having an image forming apparatus to form an image on a recording medium and a finisher to apply a finish processing to the recording medium, wherein the finisher is provided with a stacking tray on which the recording medium ejected from the image forming apparatus are stacked, the image forming apparatus, and a program to control the image forming system.

Heretofore, there has been a technology, as an image forming system, that alternately moves matching positions of recording mediums, and for example, a technology that alternately moves the matching positions by a predetermined amount in the ejection of the recording mediums to change the matching positions and stacks ejected recording mediums (see Patent Document 1). Also, a technology that precisely arranges the ejected recording mediums has been disclosed (see Patent Document 2).

[Patent Document 1]

Tokkaihei 10-181981 (Japanese Non-Examined Patent Publication)

[Patent Document 2]

Tokkai 2002-179326 (Japanese Non-Examined Patent Publication)

However, with the above background art, when a technology, that carries out an image formation of one group or plural groups of recording mediums relative to a document set and intermingles a recording medium to be finished and a recording medium to be non-finished in a single group, is applied, the matching positions of non-finished recording mediums and the finished recording mediums differ from each other, so that there arises a problem that the ejected recording mediums can not be taken out all together.

SUMMARY OF THE INVENTION

To overcome the abovementioned drawbacks in conventional image forming systems, it is an object of the present invention to provide an image forming system, an image forming apparatus and a program for controlling a image forming system, which make it possible for a user to operate them in an easy way, when a mixture mode, in which a non-finished recording medium and a finished recording medium are intermingled in a single group, is set.

Accordingly, the abovementioned object of the present invention can be attained by an image forming system, an image forming apparatus and a program for controlling an image forming system, described as follow.

(1) An image forming system, comprising an image forming apparatus to produce a printing material as one group of recording mediums or plural printing materials as plural groups of recording mediums from a single document set; and a finisher to apply a finish processing to said recording mediums ejected from said image forming apparatus, wherein said finisher is provided with a stacking tray on which said recording mediums, ejected from said image forming apparatus, are stacked, wherein said image forming system includes a controlling section to control so that, if a mixture mode, in which a non-finished recording medium and a finished recording medium are intermingled in a single group, is set, said non-finished recording medium and said finished recording medium within said single group are stacked at a same recording-medium stacking position on said stacking tray.

(2) An image forming apparatus for producing a printing material as one group of recording mediums or plural printing materials as plural groups of recording mediums from a single document set, comprising a controlling section to control a finisher which applies a finish processing to a recording mediums ejected from said image forming apparatus, said image forming apparatus is capable of being coupled to said finisher, so that, if a mixture mode, in which a non-finished recording medium and a finished recording medium are intermingled in a single group, is set, said non-finished recording medium and said finished recording medium within said single group are stacked at a same recording-medium stacking position on a stacking tray provided on said finisher.

(3) A program for executing controlling operations of an image forming system, which comprises an image forming apparatus to produce a printing material as one group of recording mediums or printing materials as plural groups of recording mediums from a single document set and a finisher to apply a finish processing to said recording mediums ejected from said image forming apparatus, said program comprising the functional step of controlling said image forming system so that, if a mixture mode, in which a non-finished recording medium and a finished recording medium are intermingled in a single group, is set, said non-finished recording medium and said finished recording medium within said single group are stacked at a same recording-medium stacking position on a stacking tray provided on said finisher.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 4(*a*) and FIG. 4(*b*) are cross-sectional views showing the configuration of a matching shift section and an ejecting section;

FIG. 6(*a*), FIG. 6(*b*) and FIG. 6(*c*) are views showing recording-medium stacking positions on a stacking tray in Embodiment 1;

FIG. 12(*a*) and FIG. 12(*b*) are stacking examples on the staking tray in the case in which offset is always prohibited in a mixture mode setting in Embodiment 2;

FIG. 13(*a*), FIG. 13(*b*), FIG. 13(*c*) and FIG. 13(*d*) are stacking example on the stacking tray in the case in which the offset setting is established in the mixture mode setting in Embodiment 2;

DETAILED DESCRIPTION OF THE PREFERRED EMBODIMENT

Hereinafter, an image forming system, an image forming apparatus and a program of "Embodiment 1" and "Embodiment 2" according to the present invention will be described with reference to the drawings.

Embodiment 1

The mechanical structure, electrical structure and operation according to the image forming system and the image forming apparatus, as well as the program to control the image forming system will be described.

(General Description)

Figure 1:
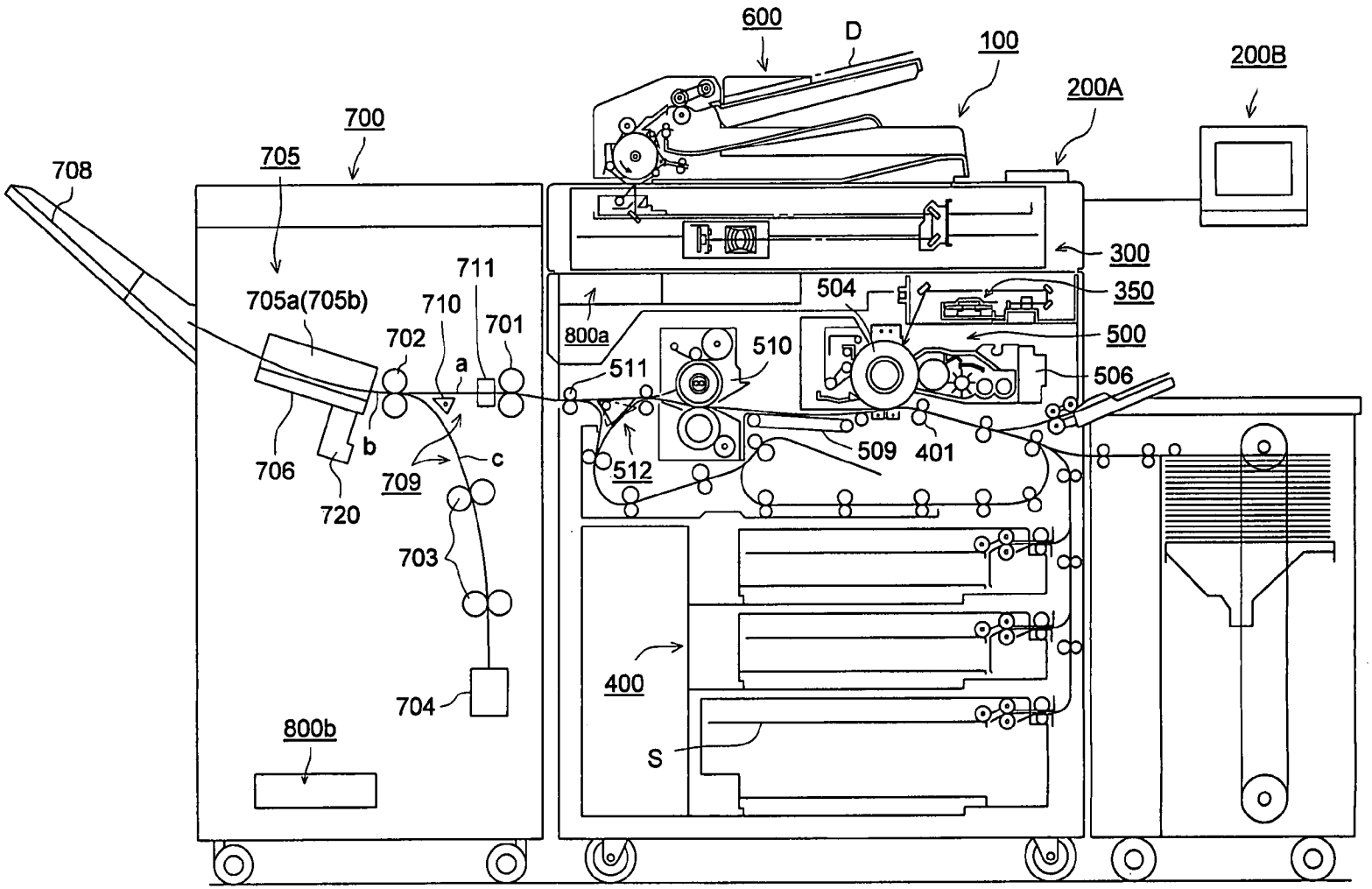
FIG. 1 is a cross-sectional view showing the general configuration of an image forming system according to an embodiment.

FIG. 1 is a cross-sectional view showing the general configuration of the image forming system according to the embodiment. As shown in FIG. 1, the image forming system is composed of an image forming apparatus 100 and a finisher 700. The image forming apparatus 100 is equipped with a controlling section 800*a* in the image forming apparatus side, an operating section 200A and an operating section 200B of an external device, a document feeder 600, a document reading section 300, a paper feeding section 400, and an image forming section 500. The finisher 700 is equipped with a controlling section 800*b* in the finisher side, a recording medium conveyance section 709, a stapler 704, a punch unit 711, a matching shift section 705, an ejecting section 720, and a stacking tray 708 on which recording mediums are stacked.

When a user set a document set, inputs job contents from the operating section 200B (or 200A) and issues an instruction of starting the image forming system, the document D placed on the document feeder 600 is fed out and read as image data in the document reading section 300. The image data is sent to an exposure section 350 within the image forming section 500 in which a light based on the image data is output, and the output light condenses and images on a photoreceptor drum 504. The photoreceptor drum 504 is charged on which an electrostatic latent image is formed by irradiating the light, and then the electrostatic latent image is developed by a development unit to form a toner image. A recording medium S fed from the paper feeding section 400 is fed to the image forming section 500 in which the toner image of the photoreceptor drum 504 is transferred onto the recording medium S. The recording medium S with the toner image transferred thereon is separated from the photoreceptor drum 504 by separation electrodes, and the separated recording medium is conveyed by a conveyer 509 to a fixing device 510 and fixed therein. The fixed recording medium S is reversed upside down in a recording-medium reverse section and fed into the finisher 700 from the image forming apparatus 100 by ejecting rollers 511.

Of the recording mediums S conveyed to the finisher 700, a recording medium S not to be finished is conveyed to a process tray 706 passing through a conveyance route a between a recording medium entry of the finisher 700 and a switching gate 710, and through a conveyance route b between the upper side of the switching gate 710 and the process tray 706 by the conveyance rollers 701, 702. While a recording medium S to be finished is once conveyed to the conveyance route a and the conveyance route b by the conveyance rollers 701 and 702, switch backed by the conveyance rollers 702 and conveyed to a conveyance route c between the lower side of the switching gate 710 and the stapler 704 which is an example of the finishing section, and then is sent to the stapler 704. A predetermined number of recording mediums S to be finished are gathered and stapled. The finished recording mediums S are conveyed to the process tray 706 passing through the conveyance route c and the conveyance route b by the conveyance rollers 703, 702. The recording mediums conveyed to the process tray 706 are matched at a predetermined matching position in the matching shift section 705, and then stacked at a predetermined recording-medium stacking position within the stacking tray 708 by the ejecting section 720.

In the image forming system of the present embodiment, when a mixture mode in which non-finished recording mediums and finished recording mediums are intermingled within a group is established, the non-finished recording mediums and the finished recording mediums within the group are stacked at the same recording-medium stacking position on the stacking tray 708. These are the descriptions of the general configuration of the image forming system according to the embodiment.

Mechanical Structure of Embodiment 1

Next, the mechanical structure of the image forming system according to Embodiment 1 will be described. Of the mechanical structure, the operating sections, the matching shift section 705 of the finisher, the ejecting section 720 and the stacking tray 708 will be described in detail.

The operating section 200A shown in FIG. 1 is provided in the upper portion of a document reading section 300, wherein job contents can be established based on the contents operated by an operator. It is also possible to provide an external device (a PC) and job contents can be established based on the job contents sent from the operating section 200B of the external device (PC). The operating sections 200A and 200B are mechanically the same, so that the description will be made about the operating section 200B below.

Figure 2:
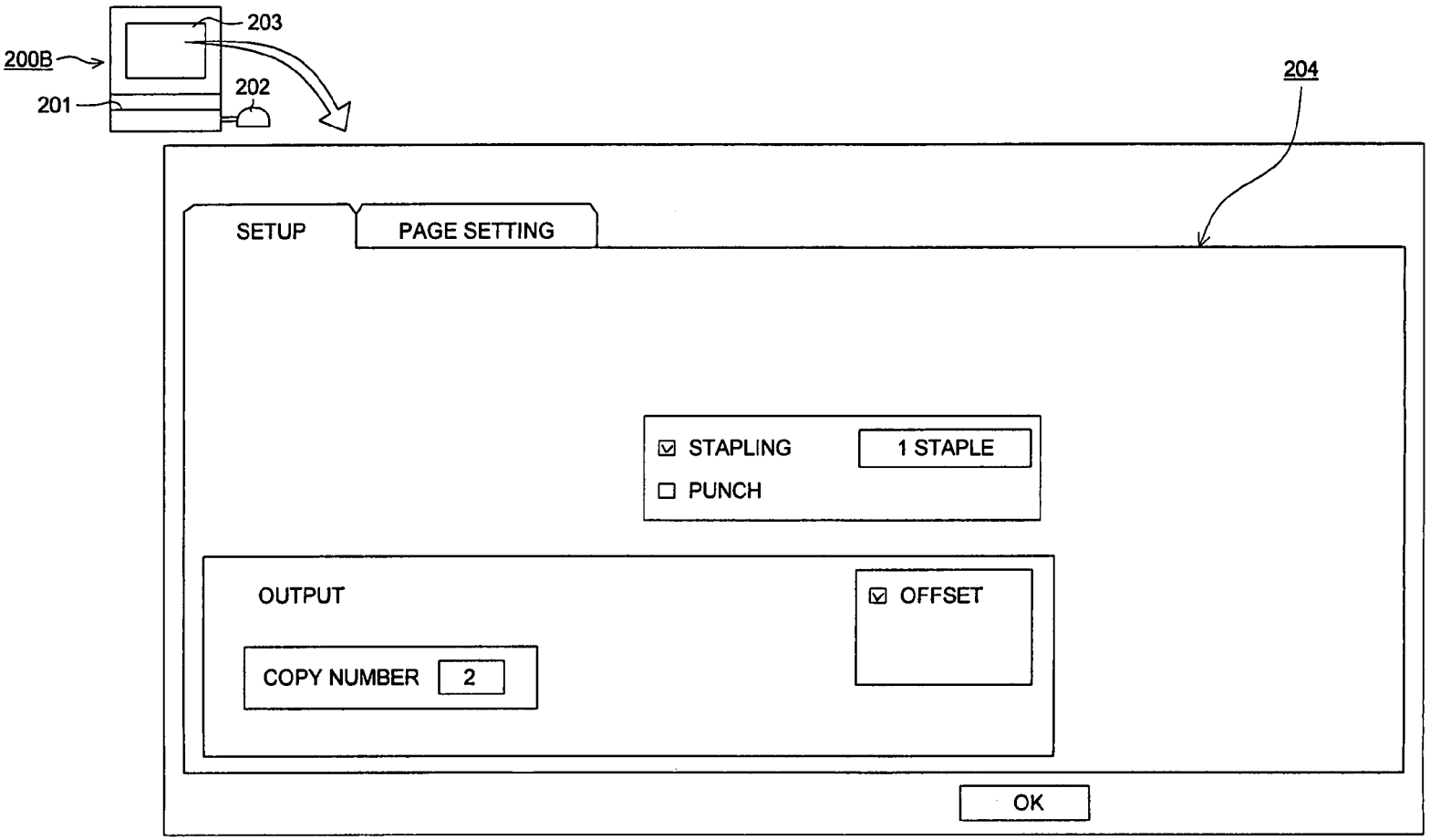
FIG. 2 is a view showing the basic setting screen of an operating section according to Embodiment 1.
Figure 3:
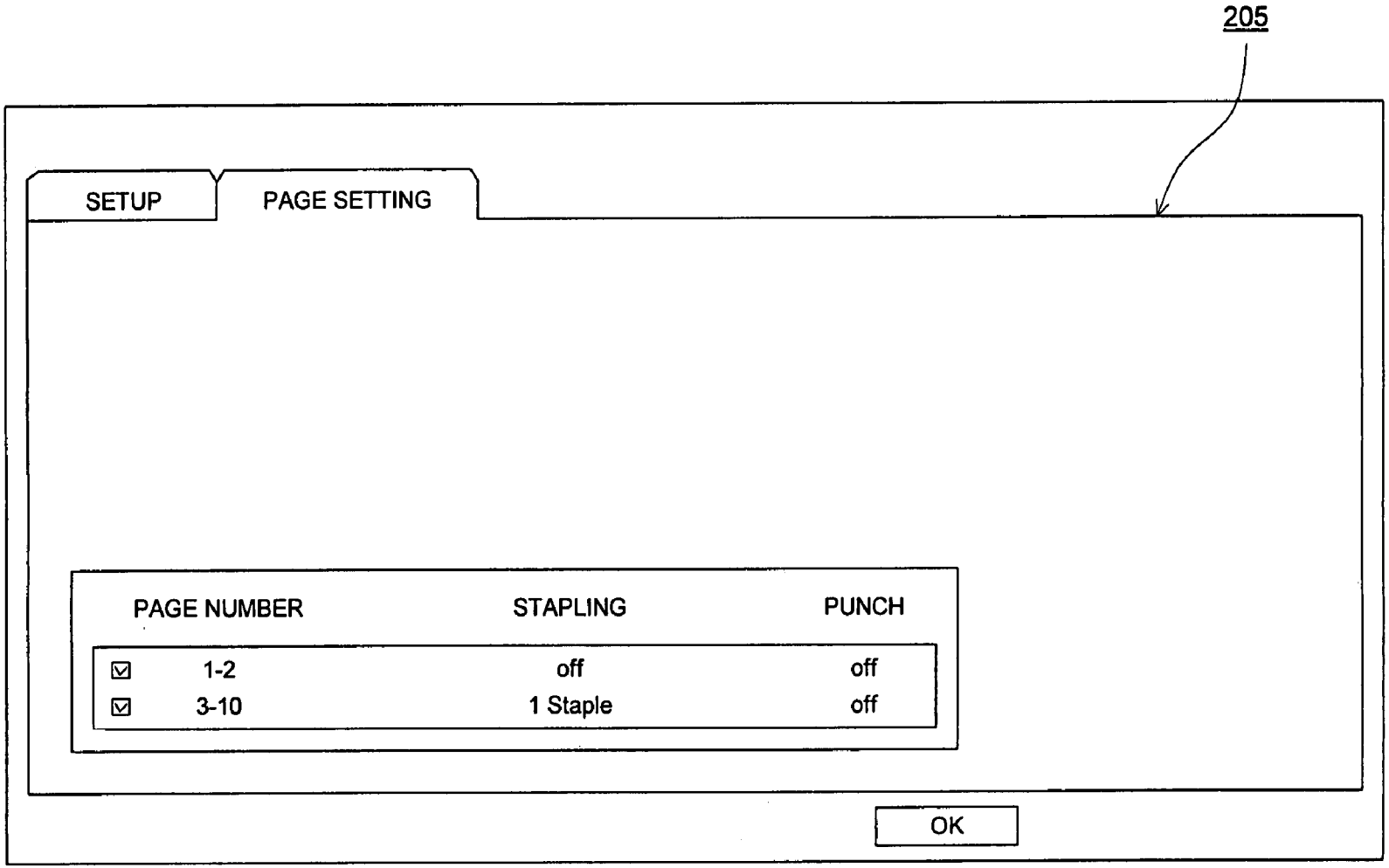
FIG. 3 is a view showing a page setting screen of the operating section according to Embodiment 1.

FIG. 2 is a view showing the basic setting screen of the operating section 200B according to Embodiment 1, and FIG. 3 is a view showing a page setting screen in the operating section 200B according to Embodiment 1.

In FIG. 2 and FIG. 3, the operating section 200B is composed of a keyboard 201, a mouse 202, and a liquid crystal section 203. In the basic setting screen 204 of FIG. 2, offset, finish processing contents, a number of copies (a number of sets) and other related contents can be established. In offset, the switching of the matching shift position of recording mediums can be enabled or disabled. Further, the setting of whether to apply a finishing processing for every page can be made in the page setting screen 205 of FIG. 3. Incidentally, an example of a set will be described as an example of a group in the embodiment.

Herein, in the case of establishing the mixture mode and when inputting a designation of a finish processing to be applied in the basic screen of FIG. 2. (designating Stapling in FIG. 2), the operator inputs off of the finish processing designation for the pages not to be finished in the page setting screen of FIG. 3. In the example of FIG. 3, the operator inputs off of stapling for 1-2 pages.

Incidentally, the operator may input a setting of pages to be finished in the page setting screen of FIG. 3 without inputting the designation of a finish processing to be applied in the basic screen of FIG. 2 (without checking the checkboxes of stapling and punch of the FIG. 2). In this case, the operator inputs "1 Staple" for stapling of 3-4 pages.

Herein, it is assumed that a group of pages not to be finished and a group of pages to be finished are sub-groups respectively. There are two sub-groups of 1-2 pages and 3-10 pages in the embodiment.

Next, the matching shift section 705 and the ejecting section 720 will be described.

FIG. 4(*a*) and FIG. 4(*b*) is are cross-sectional views showing the configuration of the matching shift section 705 and the ejecting section 720, wherein FIG. 4(*a*) is a cross-sectional view showing the partial configuration of the matching shift section 705 and ejecting section 720 as seen from the left side of the finisher, and FIG. 4(*b*) is a cross-sectional view showing the configuration of the ejecting section 720 taken along the line A-A shown in FIG. 4(*a*). Further, FIG. 5(*a*), FIG. 5(*b*) and FIG. 5(*c*) are illustrative views of the operation of the matching shift plate in the matching shift section 705.

In FIG. 4(*a*), the matching shift section 705 is composed of a first unit 705Ua shown in the right side of the figure to move one matching shift plate 705*a*, and a second unit 705Ub shown in the left side of the figure to move the other matching shift plate 705*b*. Both of these units 705Ua, 705Ub have substantially the same configuration, so that the first unit 705Ua will be described below as representing the two units.

The matching shift plate 705*a* is fixed in a carriage 708*a* capable of moving straight forward and backward sliding on a guide bar 707*a*. The carriage 708*a* is fixed in a portion of a timing belt 712*a* strung between a drive pulley 713*a* and a driven pulley 714*a*. The drive pulley 713*a* is driven and rotated from a drive motor M3 which is a drive source via a gear g1 and a gear g2. Reference numeral PS1*a* denotes a home position sensor. Similarly the second unit 705Ub is driven straight forward and backward by a drive motor M2 which is another drive source via a train of the gears and the timing belt 712*b*. As described above, the matching shift plates 705*a* and 705*b*, which are respectively equipped with the dedicated drive motors, can move independently. The drive motors M1, M2, when operated by a signal from outside, drive the matching shift plates 705*a* and 705*b* to match recording mediums to place them at a predetermined position.

Next, in FIG. 4(*b*), the ejecting section 720 ejects the recording mediums S in the process tray 706 to the stacking tray 708 (FIG. 1). A drive motor M3 drives and rotates a circular disc 721 via a train of gears composed of a gear g3 and a gear g4. An edge of a crank 722 with the other edge thereof supported at an eccentric position of the circular disc 721 is pivotably supported at a portion of a swingable ejection arm 724*a* around a fulcrum shaft 723. Further, an extrusion arm 724*b* is pivotably supported at an edge of the ejection arm 724*a*. The ejection arm 724*a* and the extrusion arm 724*b* are provided with a spring 725 therebetween, so that a spring force acts on the extrusion arm 724*b* in the clockwise direction. The circular disc 721, which is driven and rotated by the drive motor M3, causes the crank 722 to make an eccentric motion and further causes the ejecting arm 724*a* and the extrusion arm 724*b* to swing. This swing motion of the extrusion arm 724*b* pushes a rear end portion of the recording medium S to eject it toward the stacking tray 708 (FIG. 1). Incidentally, when the recording medium moves to the process tray 706, the extrusion arm 724*b* can tilt in the counterclockwise direction and stand by in the figure.

Figure 5:
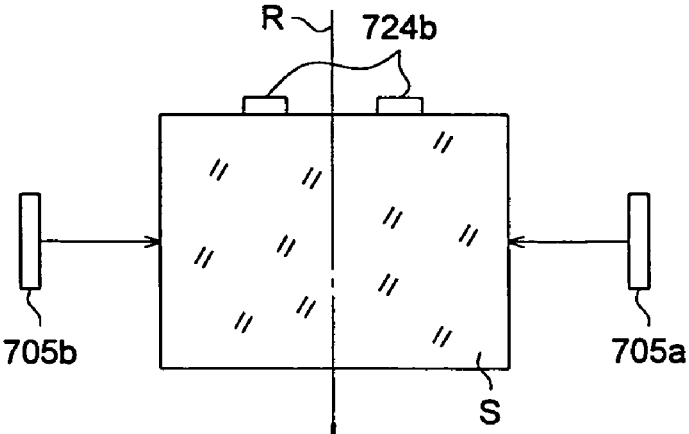
FIG. 5(*a*), FIG. 5(*b*) and FIG. 5(*c*) are illustrative view of the operation of a matching shift plate in the matching shift section.
Figure 5:
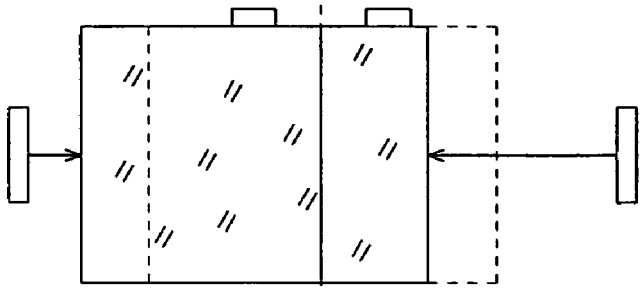
Figure 5:
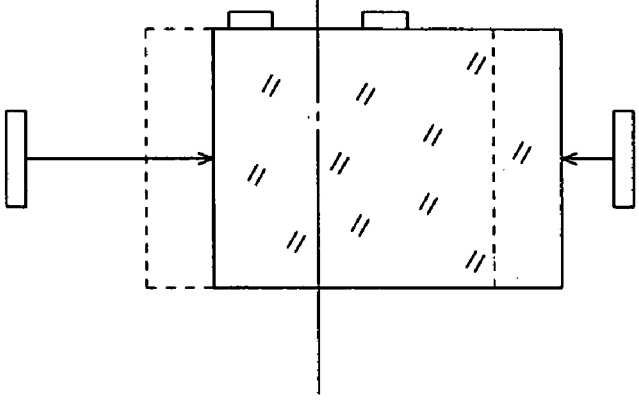

Next, the operation of the matching shift plates 705*a* and 705*b* in the matching shift section 705 will be described. FIG. 5(*a*) is an illustrative view of the case in which the recording medium is not shifted, FIG. 5(*b*) is an illustrative view of the case in which the recording medium is shifted to the back side of the image forming apparatus, and FIG. 5(*c*) is an illustrative view of the case in which the recording medium is shifted to the front side of the image forming apparatus.

At first, in FIG. 5(*a*), the matching shift plates 705*a*, 705*b* move to positions at distances equal to a center line R in the conveyance direction of the recording medium S and match the recording medium at the central position of the image forming apparatus. In FIG. 5(*b*), when offset with the back side of the image forming apparatus is established, the matching shift plates 705*a*, 705*b* move and stop at positions at different distances from the center line R in the conveyance direction of the recoding medium S and then matches the recording medium by shifting it to the back side of the image forming apparatus. Further, in FIG. 5(*c*), when offset with the front side of the image forming apparatus is established, the matching shift plates 705*a*, 705*b* move and stop at positions at different distances from the center line R in the conveyance direction of the recording medium S and then matches the recording medium by shifting it to the front side of the image forming apparatus.

Next, the description will be made about stacking of the recording mediums on the stacking tray 708.

FIG. 6(*a*), FIG. 6(*b*) and FIG. 6(*c*) are views showing the stacking state of recording mediums on the stacking tray 708 in Embodiment 1, wherein FIG. 6(*a*) shows a portion of the configuration of the above described matching shift section 705, and FIG. 6(*b*) shows the state of an example of the recording mediums stacked in the mixture mode. Incidentally, in the embodiment, the stacking state is established by default as shown in FIG. 6(*b*) in the mixture mode. It is also possible for the recording mediums to be offset for every sub-group and stacked as shown in FIG. 6(*c*) by the selection setting of the operator even in the mixture mode.

In FIG. 6(*b*), the stacking tray 708 is stacked with recording mediums that are shifted by the matching shift section 705 and ejected from the ejecting section 720 (see FIG. 4(*a*) and FIG. 4(*b*)), wherein non-finished recording mediums S1, S2 and finished recording mediums S3 to S10 constitute a group G1 which is stacked at a same recording-medium stacking position P1 of the stacking tray 708. Similarly, a group G2 is stacked at a recording-medium stacking position P2. Incidentally, the recording medium S1 is the first recording medium of a job and a recording medium S11 is the first recording medium of the group G2 which is the second group. It is assumed that in FIG. 6(*a*) and FIG. 6(*b*), G1 and G2 are the same job in which the image formation of two sets of G1 and G2 is carried out based on the image data.

If the offset designation for every sub-group is established by the operator, as shown in FIG. 6(*c*), the non-finished recording mediums S1, S2 constitute a small group (sub-group) G1*a* within the first group which is stacked at the recording-medium stacking position P1, and the finished recording mediums S3 to S10 constitute a small group (sub-group) G1*b* within the first group (within the set) which is stacked at the recording-medium stacking position P2. These small groups G1*a*, G1*b* constitute the first group G1. The same is true in the second group G2.

Electrical Structure of Embodiment 1

Next, electrical structure blocks and a flow of the program involving the recognition of recording-medium stacking positions in the image forming system according to the present embodiment will be described in relation to the electrical structure of the image forming system.

Figure 7:
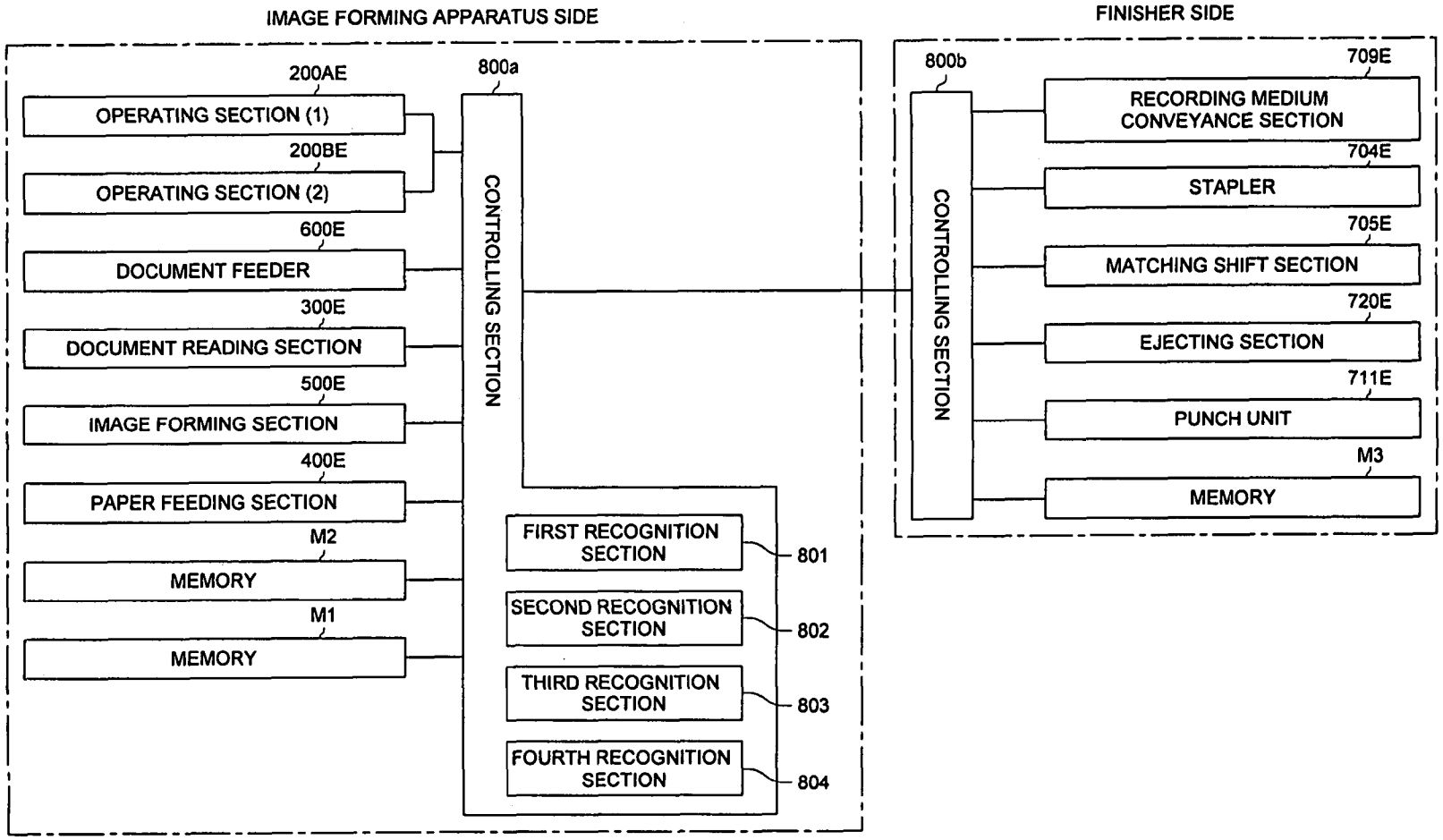
FIG. 7 is a block diagram of the electrical structure of the image forming system according to Embodiment 1.

FIG. 7 shows the electrical structure blocks of the image forming system according to Embodiment 1. The electrical structure blocks are composed of electrical structure blocks in the image forming apparatus side and in the finisher side. In the electrical structure of the image forming apparatus side, reference numeral 200AE denotes an electrical structure block of the operating section (1) 200A, reference numeral 200BE denotes an electrical structure block of the operating section (2) 200B, reference numeral 600E denotes an electrical structure block of the document feeder 600, reference numeral 300E denotes an electrical structure block of the document reading section 300, reference numeral 500E denotes an electrical structure block of the image forming section 500, and reference numeral 400E denotes an electrical structure block of the paper feeding section 400. A memory M1 is a memory that memorizes an initial position of the recording-medium stacking position, offset information and other parameters, a memory M2 is a memory that memorizes page information, paper (recording medium) information and other information. The controlling section 800*a* in the image forming apparatus side controls each of the electrical structure blocks. Further, the controlling section 800*a* has first to fourth recognition sections.

Figure 8:
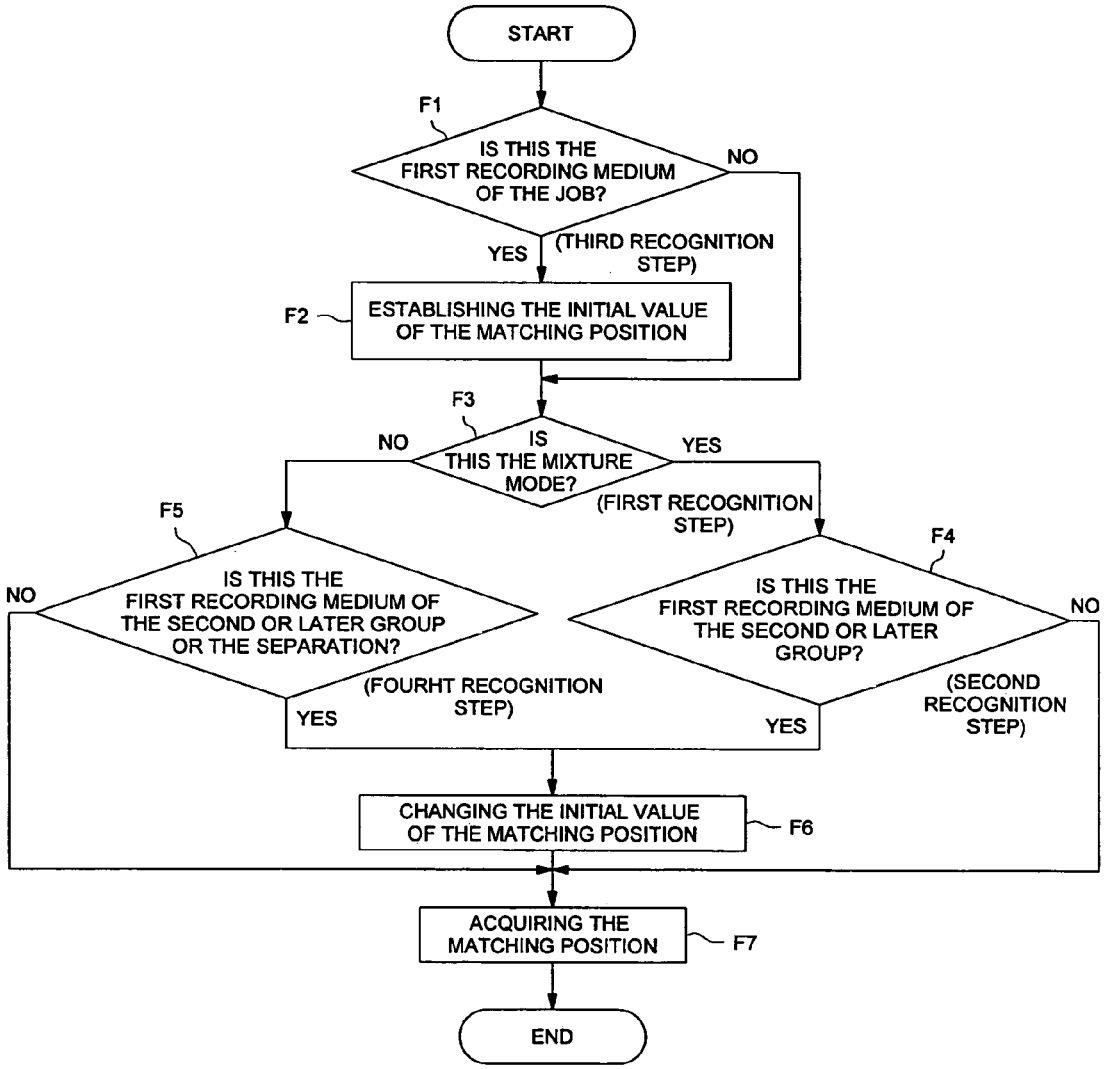
FIG. 8 is a flow of determining recording-medium stacking positions on the stacking tray according to Embodiment 1.

The first recognition section 801 recognizes whether the mode is the mixture mode or not based on a finish processing designation which is input in 204 of FIG. 2 and on the information about the existence or non-existence of the page setting which is input in the page setting screen 205 shown in FIG. 3 (see F3 of FIG. 8 described below).

For example, the case of establishing a finish processing for an image formation of a document set composed of 10 pages is exemplified. When the checkbox of "Stapling" is checked in 204 of FIG. 2, and in the page setting screen 205 of FIG. 3, stapling for the first page is set to OFF and stapling for the fourth to tenth pages is set to OFF, this is the setting in which stapling is applied to the whole group and stapling is OFF for the first page and the fourth to tenth pages that are portions of the group. In other words, the setting is established so that only the second to third pages are stapled while the first page and the fourth to tenth pages are not stapled, thereby the setting is recognized to be the mixture mode in which the first page, the second to third pages, and the fourth to tenth pages constitute small groups respectively.

Similarly, when the checkbox of "Stapling" is not checked in 204 of FIG. 2 and stapling for the second to third pages is set to ON in the page setting screen 205 of FIG. 3, this is the setting in which stapling is not applied to the whole group in 204 of FIG. 2 and stapling is applied only to the second to third pages which are a portion thereof. In other words, similarly to the above example, the setting is established so that only the second to third pages are stapled while the first page and the fourth to tenth pages are not stapled, thereby this case is recognized to be the mixture mode as well.

On the other hand, when the checkbox of "Stapling" is not checked in 204 of FIG. 2 and stapling is set to OFF for the second to third pages in the page setting screen 205 of FIG. 3, since the finish processing contents for the second to third pages and for the other pages are identical, in other words, the finish processing contents established between the first to second pages and between the third to fourth pages do not vary from each other, no small group exists within the group, and thereby the case is recognized not to be the mixture mode.

The second recognition section 802 recognizes whether the recording medium is the first recording medium of the second or later group of the job in the mixture mode (see F4 of FIG. 8). The third recognition section recognizes whether the recording medium is the first recording medium of the job (see F1 of FIG. 8). Further, the fourth recognition section 804 recognizes whether the recording medium is the first recording medium of the second or later group (the second set) or the first recording medium of a separation (see S3, S13 of FIG. 8*c*) in the non-mixture mode (see F5 of FIG. 8).

Herein, the separation is a boundary of a chapter and the like made by the user other than the group unit.

Next, in the electrical structure of the finisher side, reference numeral 709E denotes an electrical structure block of the recording-medium conveyance section 709, reference numeral 704E denotes an electrical structure block of the stapler 704, reference numeral 705E denotes an electrical structure block of the matching shift section 705, reference numeral 720E denotes an electrical structure block of the ejecting section 720, and reference numeral 711E denotes an electrical structure block of the punch unit 711. A memory M3 is a memory for the paper feeding information (including the recording-medium stacking position information). The controlling section 800*b* in the finisher side controls each of the blocks in the finisher side.

The control of recognizing the recording-medium stacking position of recording mediums to the stacking tray 708 in the image forming system (FIG. 8) is executed by the controlling section 800*a* in the image forming apparatus side, wherein the controlling section 800*a* sends its execution result to the controlling section 800*b* in the finisher side, and the controlling section 800*b* controls the ejection of the recording medium by controlling the matching shift section 705E and other sections based on the information.

Next, the flow of the program involving the recognition of the recording-medium stacking position in the image forming system of Embodiment 1 will be described. FIG. 8 is a flow of recognizing the recording-medium stacking position on the stacking tray in the image forming system of Embodiment 1. In FIG. 8, it is first recognized whether the recording medium is the first recording medium of the job by the third recognition section 803, and when it is the first recording medium of the job, the process proceeds to the next step F2, while it is not the first recording medium of the job, the process proceeds to F3 (F1). When the recording medium is the first recording medium of the job, herein the initial value of the matching position for the matching shift section 705 is established to a predetermined matching position. Incidentally, the established initial value is stored in a memory M1 shown in FIG. 7 (F2). Next, it is recognized whether the mixture mode is established by the first recognition section 801 in F3, and when the mixture mode is established (YES), the process proceeds to F4, while when the mixture mode is not established (NO), the process proceeds to F5. When the mixture mode is established, it is recognized whether the recording medium is the first recording medium of the second or later group by the second recognition section 802 in F4, and when the recording medium is the first recording medium thereof (YES), the process proceeds to F6, while when it is not the first recording medium thereof, the process proceeds to F7.

Next, when the mixture mode is not established, it is recognized whether the recording medium is the first recording medium of the second or later group or the first recording medium of the separation by the fourth recognition section 804 in F5, and the process proceeds to F6 when YES, while the process proceeds to F7 when NO. The established initial value of the matching position is changed in F6. In other words, the initial value memorized in the memory M1 shown in FIG. 7 is changed (F6). Further, in F7, the matching position of the matching shift section is acquired from the memory M1 shown in FIG. 7 and recognized according to the recognition result in F3, F4 and F5 described above (F7). Subsequently, the information about the recognition matching position is sent from the controlling section 800*a* to the controlling section 800*b*.

Next, the operation of the image forming system of Embodiment 1 is illustrated and described with reference to the above described general configuration, mechanical structure and electrical structure of the image forming system.

An example of the case of producing a printing material as two sets (G1 and G2) relative to a document set, wherein the first and second pages are not finished and the third to tenth pages are applied to finished (stapled) will be described with reference to FIG. 1 to FIG. 8.

The document D shown in FIG. 1 is set in the document feeder 600, and in the operating section 200B, stapling is enabled in the basic setting screen 204 shown in FIG. 2, the copy number is designated to 2 sets, and offset is enabled. Further, the existence of the finish processing for every page and its position and the other parameters are designated in the page setting screen 205 shown in FIG. 3.

The recording-medium stacking position information recognized by the set contents of the job is notified to the controlling section 800*b* of the finisher 700, together with the other paper feeding information, at the paper feeding timing for every recording medium. The finisher 700 temporarily stores the notified paper feeding information (including the recording-medium stacking position information) in the memory M3.

Herein, when a start button not shown is pressed, the document D is read by the document reader 600 shown in FIG. 1 and an image formation is carried out. The first and second pages of the first group are fed into the finisher 700 and conveyed to the process tray 706. The third to tenth pages of the first group are fed into the finisher 700, stapled by the stapler 704, and conveyed to the process tray 706. Subsequently, based on the information about the matching position sent from the controlling section 800*a*, the controlling section 800*b* controls the matching shift section 705E so that the first to tenth pages of the first group on the process tray 706 are at the recording-medium stacking position P1 and matches the recording-medium bundle position to a position corresponding to P1 on the process tray 706. The recording mediums are then ejected at the recording-medium stacking position P1 of the stacking tray 708 through the ejecting section 720 shown in FIG. 4(*a*) and FIG. 4(*b*).

Similarly, the first and second pages of the second group are fed into the finisher 700 and conveyed to the process tray 706. The third to tenth pages of the second group are fed into the finisher 700, stapled by the stapler 704, and conveyed to the process tray 706. Subsequently, based on the information about the matching position sent from the controlling section 800*a*, the controlling section 800*b* controls the matching section 705E, and matches the recording-medium bundle position to a position corresponding to P2 on the process tray 706 so that the first to tenth pages of the second group are placed at the recording-medium stacking position P2 on the process tray. The recording mediums are ejected at the recording-medium stacking position P2 of the stacking tray 708 through the ejecting section 720 (see FIG. 6(*b*)).

As described above, with the image forming system of Embodiment 1, non-finished recording mediums and finished recording mediums within a group of recording mediums can be stacked at the same recording-medium stacking position on the stacking tray. The recording-medium stacking position is changeable for every group of recording mediums, so that the separation of every group is easily identifiable. Incidentally, the recognition by the first recognition section, second recognition section and third recognition section allow a simple and reliable control of the recognition of recording-medium stacking positions. With the image forming apparatus, the above described advantage can be achieved by combining with the above described finisher. Further, with the program, a program capable of controlling the image forming system will be realized, and particularly when the mixture mode is established, the image forming system can be controlled so that the non-finished recoding mediums and the finished recording mediums within the group are stacked at the same recording-medium stacking position on the stacking tray.

Embodiment 2

Next, an image forming system, the mechanical structure, electrical structure and operation of an image forming apparatus, and a program to control the image forming apparatus according to Embodiment 2 will be described. Incidentally, the same reference numerals are assigned to the portions functionally and mechanically similar to Embodiment 1 and the description thereof is partially omitted, and mainly the portions different from those in Embodiment 1 will be described. Further, the general configuration of the image forming system according to Embodiment 2 is structurally similar to Embodiment 1, so that its description will be omitted.

Mechanical Structure of Embodiment 2

Of the mechanical structure in the image forming system, the operating section of the image forming apparatus, and the matching shift section 705, ejecting section 720 and stacking tray 708 of the finisher according to the present embodiment will be described in detail.

Figure 9:
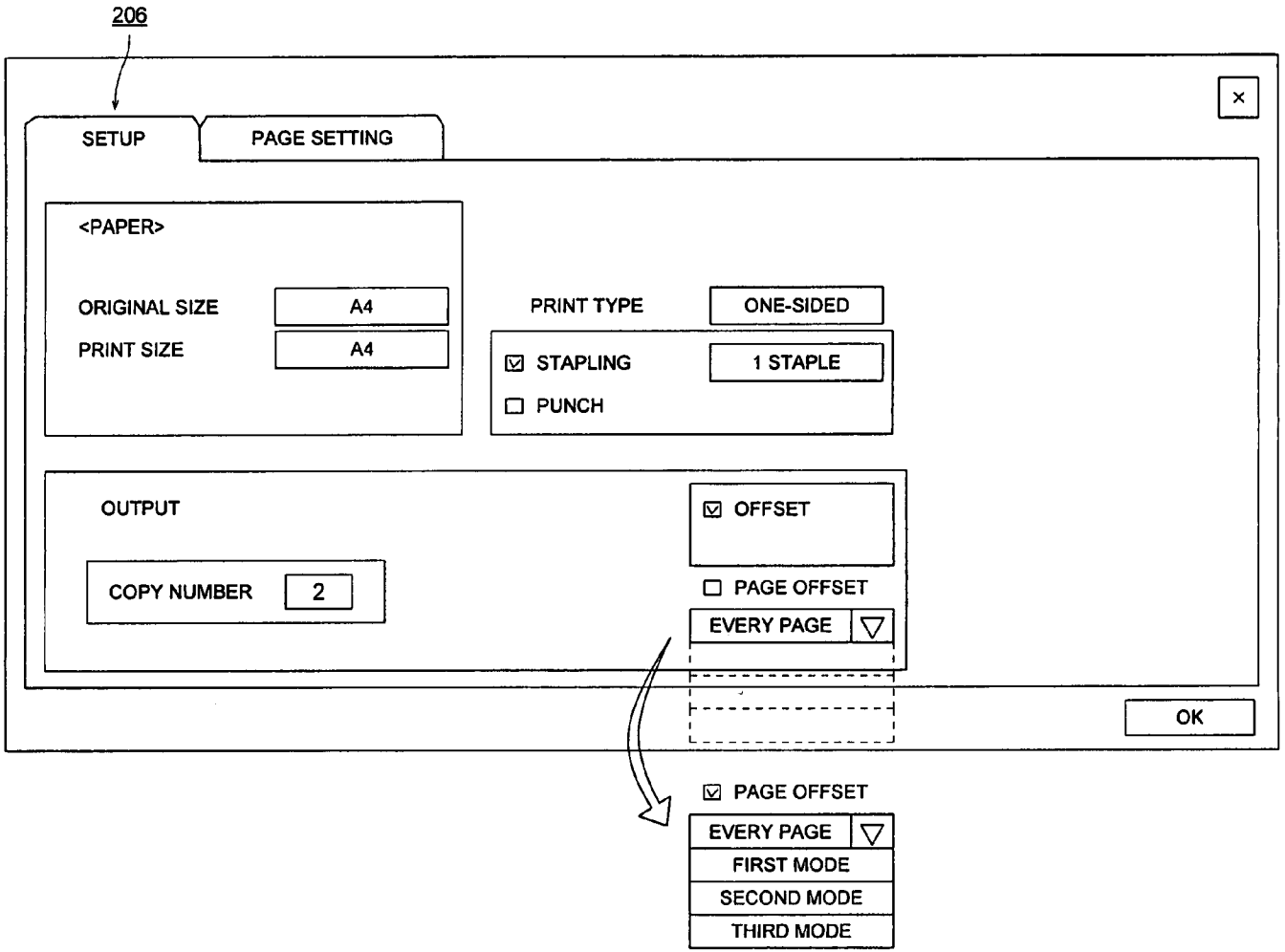
FIG. 9 is a view showing a basic setting screen of the operating section according to Embodiment 2.

Hereinafter, the description will be made about the operating section 200B as the operating section similarly to Embodiment 1. FIG. 9 is a view showing a basic setting screen 206 of the operating section according to Embodiment 2, FIG. 10 is a view showing a page setting screen 207 of the operating section according to Embodiment 2, and FIG. 11 is a view showing a page detail setting screen 208 according to Embodiment 2.

As shown in FIG. 9, the setting for a whole job is established in the basic setting screen 206. The contents of the setting include the document size, print size, print type (one-sided, two-sided), finish processing (staple, punch and the like), offset ON/OFF, offset ON/OFF for every page, copy number and the like. Offset ON or OFF for the whole job can be designated in the checkbox of "offset". Further, offset ON or OFF for every page can be established in the checkbox of "page offset". When the offset checkbox is ON, as shown in the lower part of the basic setting screen 206 of FIG. 9, a list is displayed from which a mode can be selected from plural modes of how to offset for every page. More particularly, the setting of "page offset" can be selected and established from a first mode to prohibit offset, a second mode to offset for every group, and a third mode to offset for every subset group.

Incidentally, in the embodiment, offset is not carried out in the mixture mode, even if the "offset" check or the "page offset" check is ON, in other words, the default setting is established to control offset to be prohibited in the mixture mode. Incidentally, this setting is changeable by an administrator or a user. It is possible to establish the setting to allow the offset control depending on the mode selected from the first to third modes described below even in the mixture mode by selecting "offset in the mixture mode" and establishing in an offset control setting screen in the mixture mode not shown.

Figure 10:
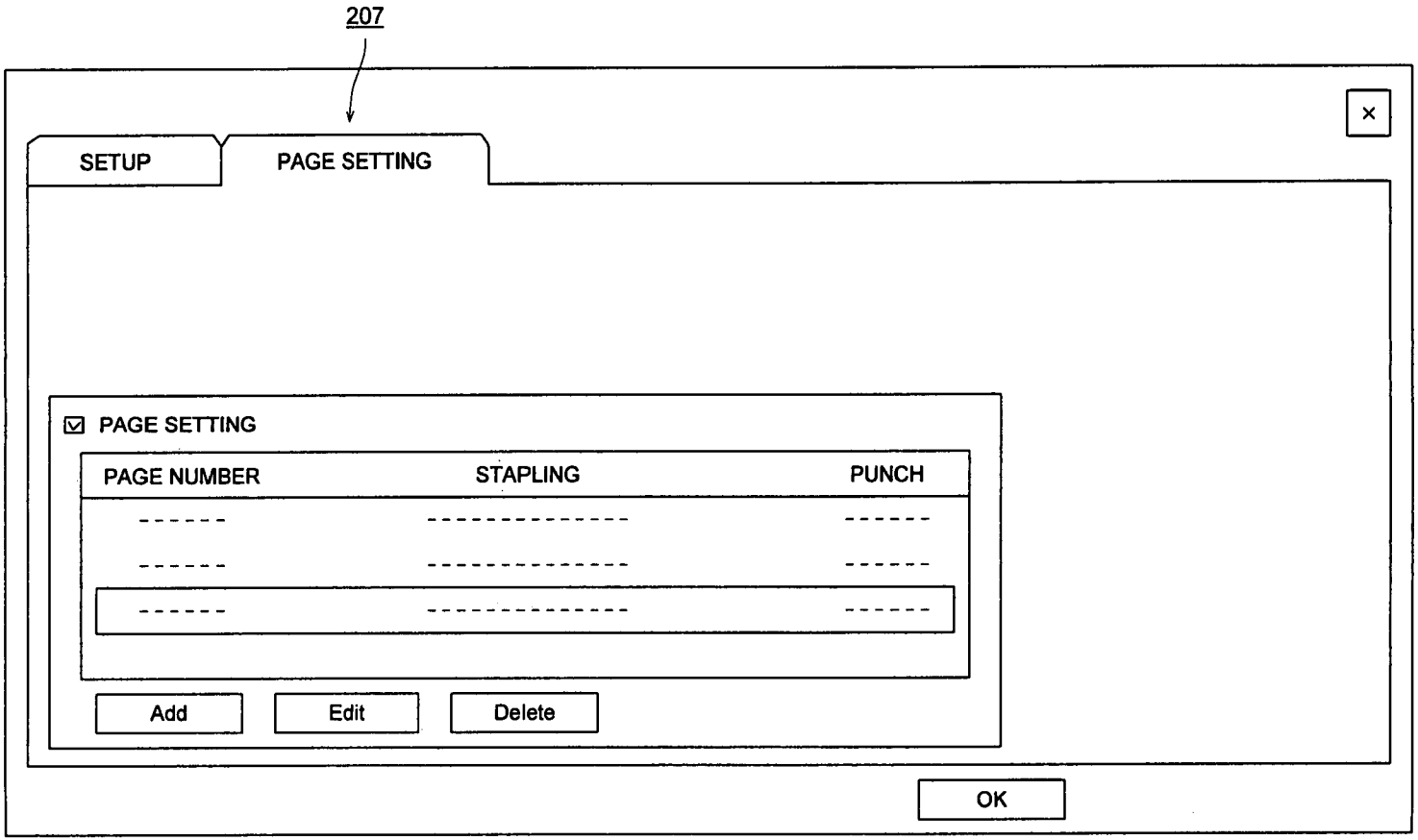
FIG. 10 is a view showing a page setting screen of the operating section according to Embodiment 2.
Figure 11:
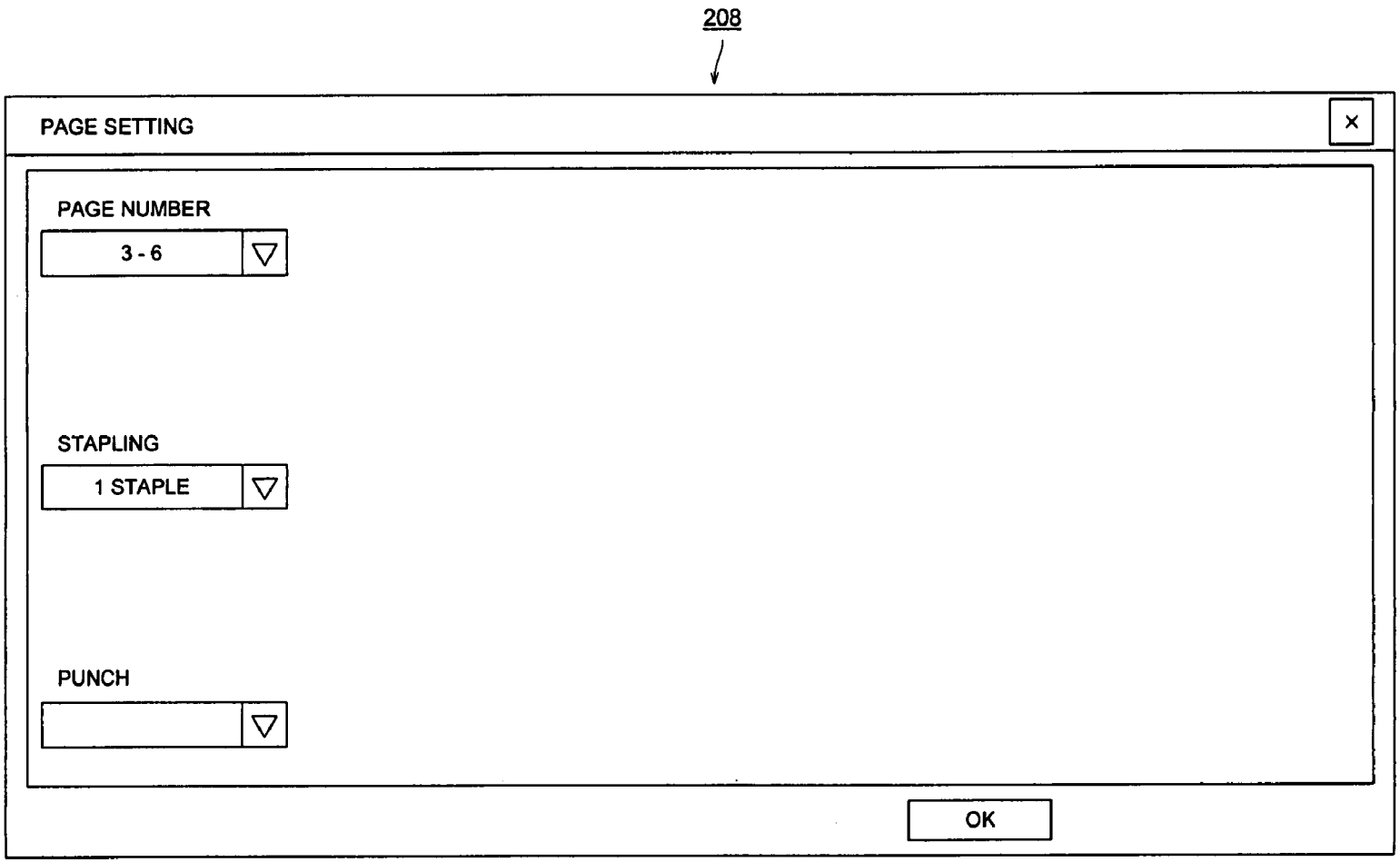
FIG. 11 is a view showing a page detail setting screen of the operating section according to Embodiment 2.

Further, the page setting screen 207 shown in FIG. 10 is displayed when the "page setting" tag at the upper part of the basic setting screen 206 is selected.

As shown in FIG. 10, when the checkbox of "page setting" is ON in the page setting screen 207, the enable/disable of the finish processing for every page of subset-staple can be established (when ON, a portion displayed in the list within the frame at the bottom thereof will be enabled).

Further, the detail setting of the list described above can be established with three buttons ("Add", "Edit", and "Delete") at the lower part of the screen of the page setting screen 207.

"Add" is a button for carrying out a new addition to the list, "Edit" is a button for selecting an item in the list and editing the setting contents, and "Delete" is a button for selecting an item in the list and deleting the selected item.

When "Add" or "Edit" is selected, the page detail setting screen 208 shown in FIG. 11 which is another form for the setting and input is displayed.

The contents of the finish processing such as the detailed page designation and the staple designation can be established in the page detail setting screen shown in FIG. 11. Incidentally, the setting of the page detail setting screen 208 of FIG. 11 has priority over the setting of the page setting screen 207 in FIG. 10.

Herein, as an example of the setting, the case in which a first group (first set) is a 6-page job, wherein staple is disabled for the first to second pages and subset-staple for the third to sixth pages is designated will be described. At first, staple is set to ON in the basic setting screen 206 of FIG. 9, and then staple is set to OFF for the first to second pages in the page detail setting screen 208 of FIG. 11. Incidentally, the setting can be established by another setting method in which staple is first set to OFF in the basic setting screen 206 of FIG. 9 and then staple is set to ON for the third to sixth pages in the page detail setting screen of FIG. 11.

Next, the description will be made about stacking on the stacking tray 708. Incidentally, the matching shift section 705 and the ejecting section 720 are mechanically the same as Embodiment 1.

FIG. 12(*a*) and FIG. 12(*b*) are examples of stacking on the stacking tray in the case of prohibiting offset in the mixture mode setting, namely, in the default setting. FIG. 12(*a*) shows a portion of the configuration of the above described matching shift section 705, in which the matching shift plates 705*a*, 705*b* are provided.

FIG. 12(*b*) shows the stacking state of recording mediums, and more particularly, it shows the stacking state in which non-finished recording mediums S1, S2 and finished recording mediums S3 to S6 constitute a first group G1 which is stacked at a recording-medium stacking position P3 of the stacking tray 708, and a second group G2 is similarly stacked at the same recording-medium stacking position P3 when the mixture mode is established. Incidentally, the recording medium S1 is the first recording medium of the job, and this embodiment also shows, similarly to Embodiment 1, an example of a set as an example of a group.

Next, FIG. 13(*a*), FIG. 13(*b*), FIG. 13(*c*) and FIG. 13(*d*) are examples of a stacking on the stacking tray in the case of allowing offset in the mixture mode setting, in other words, in the case in which "offset in the mixture mode" is established through the offset control setting screen in the mixture mode not shown, "page offset" of FIG. 9 is set to ON and a mode is designated from plural modes. FIG. 13(*a*) shows the general configuration of the matching shift section 705, FIGS. 13(*b*) to 13(*d*) show the stacking states of the mode designation examples from the first to third mixture modes, wherein FIG. 13(*a*) is similar to FIG. 12(*a*) and the description thereof is omitted.

In the first mode, as shown in FIG. 13(*b*), the non-finished recording mediums S1, S2 and the finished recording mediums S3 to S6 constitute the first group G1 which is stacked at the recording-medium stacking position P3 of the stacking tray 708, and the second group G2 is similarly stacked at the same recording-medium stacking position P3. Incidentally, the recording medium S1 is the first recording medium of the job.

In the second mode, as shown in FIG. 13(*c*), the non-finished recording mediums S1, S2 and the finished recording mediums S3 to S6 constitute the first group G1 which is stacked at the recording-medium stacking position P1 of the stacking tray 708, and the second group G2 is stacked at the recording-medium stacking position P2. Incidentally, the recording medium S1 is the first recording medium of the job and the recording medium S6 is the last recording medium within the group.

In the third mode, as shown in FIG. 13(*d*), the non-finished recording mediums S1, S2 constitute a sub-group G1*a* within the first group, and the sub-group G1*a* is stacked at the recording-medium stacking position P1. Further, the finished recording mediums S3 to S6 constitute a sub-group G1*b* within the first group, and the sub-group G1*b* is stacked at the recording-medium stacking position P2. These sub groups G1*a*, G1*b* constitute the first group G1. The same is true in the second group G2. Incidentally, the recording medium S1 is the first recording medium of the job, and the recording mediums S2, S6 and so on are the last recording mediums of the subset groups.

Electrical Structure of Embodiment 2

Next, the electrical structure blocs and the flow of the program involving the recognition of the recording-medium stacking position according to the present embodiment, will be described in relation to the electrical structure of the image forming system.

The electrical structure blocks of the image forming system according to Embodiment 2 are similar to Embodiment 1 and the description thereof is omitted.

The image forming system of Embodiment 2 is designed, similarly to the above described Embodiment 1, that the ejection control of recording mediums to the stacking tray 708 is executed by the above described controlling section 800*a* in the image forming apparatus side, wherein the controlling section 800*a* sends its execution result to the controlling section 800*b*, and the controlling section 800*b* in the finisher side controls the ejection of the recording mediums based on the information.

Further, the controlling section 800*a* recognizes whether the mode is the mixture mode or not based on the finish processing designation which is input in the setup screen of FIG. 9 and the information of the existence of the page setting which is input in the page setting screen 207 shown in FIG. 10. Incidentally the recognition can be made in a manner similar to Embodiment 1.

Next, the description will be made about the flow of the program involving the recognition of the recording-medium stacking positions that is executed by the controlling section 800*a* in the image forming system of Embodiment 2.

There are two types of flows, a first flow for the case in which offset is always prohibited in the mixture mode setting and a second flow for the case in which the offset setting is designated in the mixture mode, and the both flows will be described respectively.

In the controlling section 800*a*, the second flow is selected when "offset in the mixture mode" is established, and the first flow is selected in the default setting in the offset control setting screen in the mixture mode not shown.

Incidentally, the recording-medium stacking position information recognized in the flow is notified to the controlling section 800*b* of the finisher, together with the other paper feeding information, at the paper feeding timing for every recording medium. The finisher temporarily stores the notified paper feeding information (including the recording-medium stacking position information) in the memory to control the recording-medium stacking position referring to the information at the ejecting timing.

Figure 14:
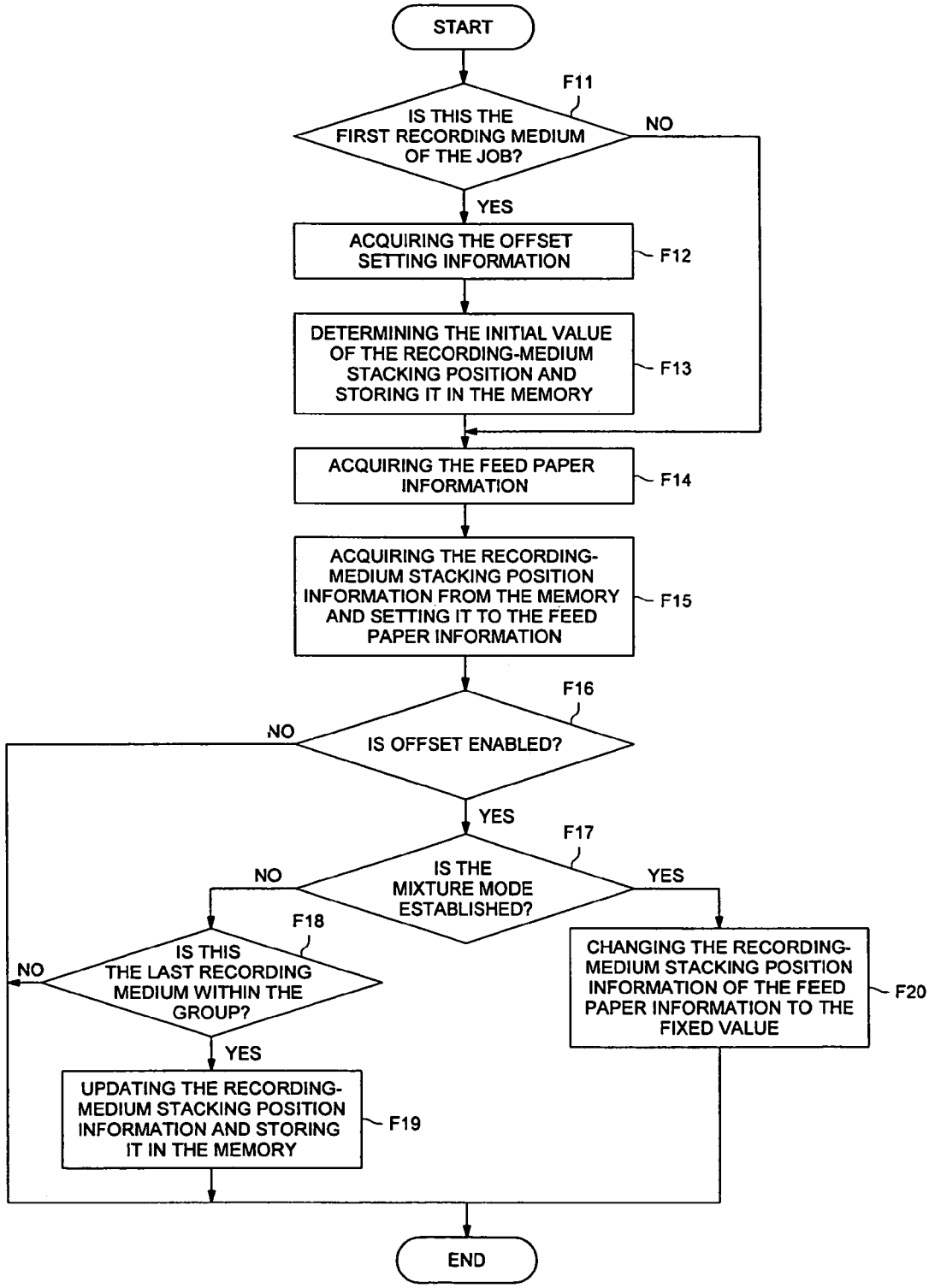
FIG. 14 is a flow of determining recording-medium stacking positions on the stacking tray according to Embodiment 2.

At first, the description will be made about the first flow of the case in which offset is always prohibited in the mixture mode setting, in other words, "page offset" is set to ON and the mode is not established. FIG. 14 is the first flow that recognizes recording-medium stacking positions on the stacking tray 708 according to Embodiment 2. In FIG. 14, it is recognized whether the recording medium is the first recording medium of the job by the third recognition section in F11, and when it is the first recording medium of the job, the process proceeds to F12. While when the recording medium is not the first recording medium of the job, the process proceeds to F14. In F12, the offset setting information is acquired. In F13, the initial value of the recording-medium stacking position (which is assumed to be the recording-medium stacking position P1 in the embodiment) is recognized and stored in the memory M3. In F14, the feed paper (recording medium) information is acquired. In F15, the recording-medium stacking position information is acquired from the memory M3, and the information is set to the feed paper information of an image memory not shown.

In F16, it is recognized whether the offset designation exists, and when offset is designated, the process proceeds to F11, while when offset is not designated, the process ends here. In F17, it is recognized whether the mixture mode designation exists by the first recognition section. When the mixture mode is designated, the process proceeds to F20, and when the mixture mode is not designated, the process proceeds to F18. In F18, it is recognized whether the recording medium is the last recording medium within the group by the second recognition section, and when it is not the last recording medium, the process ends here, while when it is the last recording medium, the process proceeds to F19, updating the recording-medium stacking position information (updating the recording-medium staking position from P1 to P3) and storing the updated information in the memory, and then the process ends. In F20, the process changes the recording-medium stacking position of the feeding recording medium information to the fixed value (changes the recording-medium stacking position from P1 to P3) and then ends.

Figure 15:
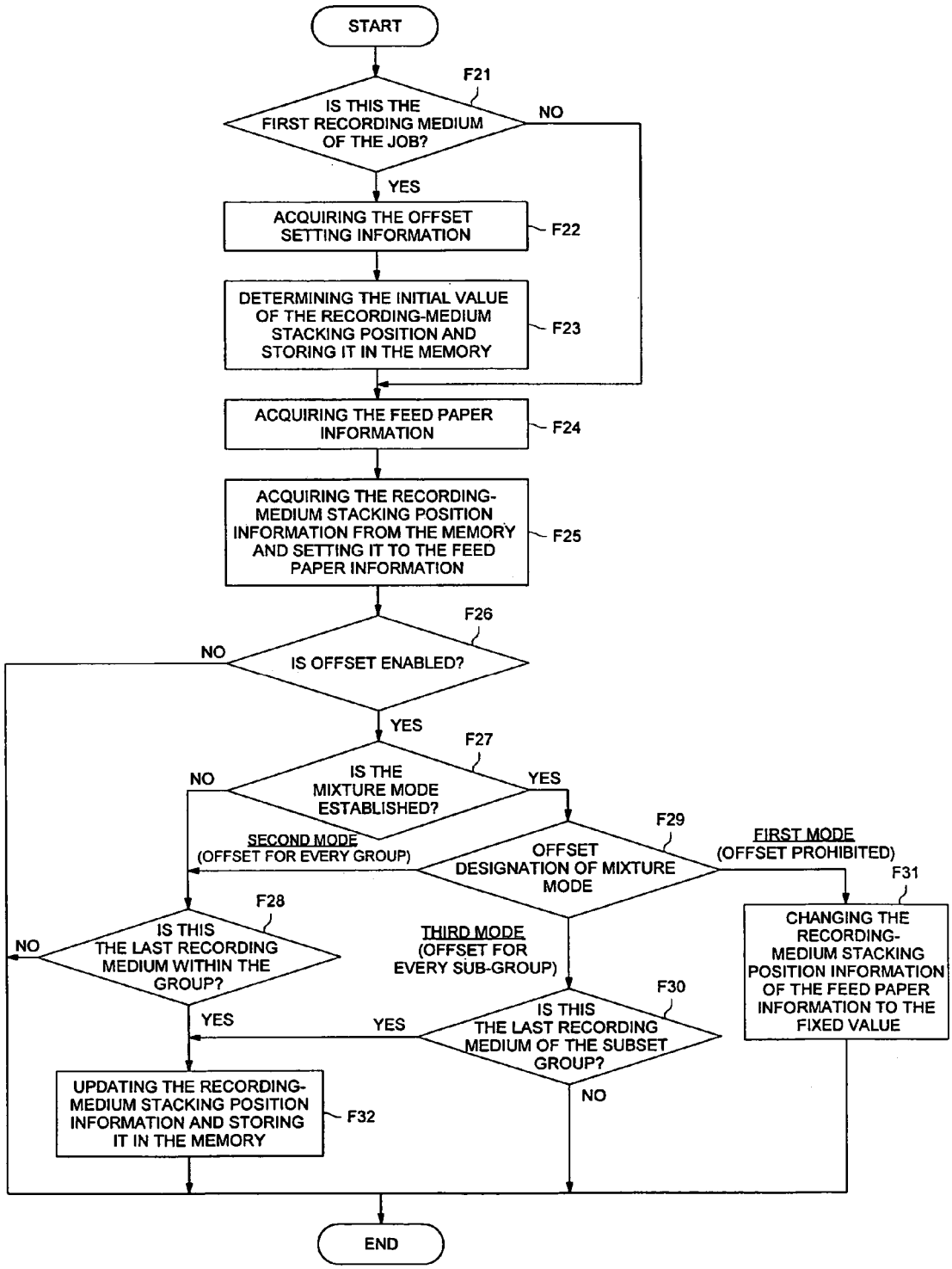
FIG. 15 is a flow of determining the recording-medium stacking positions on the stacking tray according to Embodiment 2.

Next, the description will be made about the program (second flow) of the case in which "page offset" is ON in the mixture mode and plural modes are designated. FIG. 15 is the second flow that recognizes recording-medium stacking positions on the stacking tray 708 according to Embodiment 2. In FIG. 15, F21 to F25 are the same as F11 to F15 shown in FIG. 14 described above and the description thereof is omitted. In F26, it is recognized whether the offset designation exists, and when offset is designated, the process proceeds to F27, while when offset is not designated, the process ends here. In F27, it is recognized whether the mode is the mixture mode, and when it is the mixture mode, the process proceeds to F29, while when not the mixture mode, the process proceeds to F28. In F28, it is recognized whether the recording medium is the last recording medium within the group by the second recognition section, and when it is not the last recording medium, the process ends here, while when the last recording medium, the process updates the recording-medium stacking position information and stores in the memory in F32, and then it ends. In F29, the offset designation content of the mixture mode is recognized. More particularly, it is recognized which mode is selected among the first mode, the second mode and the third mode. In the case of the first mode which is the offset prohibition designation, the process changes the recording-medium stacking position of the feed recording medium information to the fixed value (P3) in F31, and then ends. In F29, when the mode is the third mode which is the offset designation for sub-group in the mixture mode, the process proceeds to F30 in which it is recognized whether the recording medium is the last recording medium of the subset group, and when it is the last recording medium, the process proceeds to F32, while when it is not the last recording medium, the process ends here. Further, in F29, when the mode is the second mode which is the offset designation for every group, the process proceeds to F28.

Next, examples of the operations in the cases in which offset is always prohibited in the mixture mode setting and offset is established in the mixture mode setting will be respectively described with reference to the above described mechanical structure and electrical structure, in relation to the operation of the image forming system of Embodiment 2.

As an example, the case of producing a printing material relative to a document set as two sets of recording mediums, wherein the first and second pages of the recording mediums are not finished and the third to sixth pages of the recording mediums are finished (stapled) will be described.

(The Case in Which Offset is Always Prohibited in the Mixture Mode Setting)

The document D shown in FIG. 1 is set in the document feeder 600. The job contents are set in the operating section 200B. More particularly, offset is enabled, stapling is enabled, and the copy number is designated as 2 sets in the basic setting screen 206 shown in FIG. 9. Next, the page setting is enabled, and "Add" is selected in the page setting screen shown in FIG. 10. Further, 1 Staple is designated and the page number is designated as 3-6 pages in the page detail setting screen 208 shown in FIG. 11.

The recording-medium stacking position information recognized by the set contents of the job is notified to the controlling section 800*b* of the finisher 700, together with the other paper feeding information, at the paper feeding timing for every recording medium, and the finisher 700 temporarily stores the notified paper feeding information (including the recording-medium stacking position information) in the memory M3.

Next, when the start button not shown is pressed, the document D is read by the document reader 600 and the image formation is carried out. The first and second pages of the first group are fed into the finisher 700. They are conveyed to the process tray 706. Further, the third to sixth pages of the first group are fed into the finisher 700, stapled by the stapler 704 and conveyed to the process tray 706.

The controlling section 800*b* recognizes the recording-medium stacking position based on the paper feeding information temporarily stored in the memory M3, controlling the matching shift 705E, matching the recording-medium bundle position to a position corresponding to P3 on the process tray 706 to eject the recording mediums at the recording-medium stacking position P3 of the stacking tray 708 through the ejecting section 720.

Similarly, the first and second pages of the second group are fed into the finisher 700 and conveyed to the process tray 706. Next, the third to sixth pages of the second group are fed into the finisher 700 and stapled by the stapler 704. The stapled recording mediums are conveyed to the process tray 706, ejected at the same recording-medium stacking position P3 of the stacking tray 708 and then stacked as shown in FIG. 12(*b*).

Incidentally, when the mixture mode is not designated, the recording-medium stacking positions are matched on the process tray 706 so that the first group is stacked at the recording-medium stacking position P1 and the second group is stacked at the recording-medium stacking position P2.

(The Case of Establishing Offset in the Mixture Mode)

The offset selection setting is made by selecting one from the above described "first mode", "second mode", and "third mode".

At first, the operation of the "first mode" will be described.

The document D shown in FIG. 1 is set in the document feeder 600. The job contents are set in the operating section 200B. More particularly, staple is enabled and the copy number is designated as 2 sets in the basic setting screen 206 shown in FIG. 9. Further, offset is enabled, page offset is enabled and the first mode is designated. Page setting is enabled and "Add" is selected in the page setting screen 207 shown in FIG. 10. Further, 1 Staple is designated and the page number is designated as 3-6 pages in the page detail setting screen 208 shown in FIG. 11.

The recording-medium stacking position information recognized by the set contents of the job is notified to the controlling section 800*b* of the finisher 700, together with the other paper feeding information, at the paper feeding timing for every recording medium. The finisher 700 temporarily stores the notified paper feeding information (including the recording-medium stacking position information) in the memory M3.

When the start button not shown is pressed, the document D is read by the document reader 600 and the image formation is carried out. The first and second pages of the first group are fed into the finisher 700. They are conveyed to the process tray 706. The third to sixth pages of the first group are fed into the finisher 700, stapled by the stapler 704, and conveyed to the process tray 706. The recording-medium stacking position is recognized based on the paper feeding information which is temporarily stored in the memory M3, the matching shift 705E is controlled to match the recording-medium bundle position to a position corresponding to P3, and the recording mediums are ejected at the recording-medium stacking position P3 of the stacking tray 708 through the ejecting section 720. Similarly, the first and second pages of the second group are fed into the finisher 700. They are conveyed to the process tray 706. The third to sixth pages of the second group are fed into the finisher 700 and stapled by the stapler 704. They are conveyed to the process tray 706. The recording-medium stacking position is recognized based on the paper feeding information which is temporarily stored in the memory M3, the matching shift 705E is controlled to match the recording-medium bundle position to the position corresponding to P3 on the process tray 706, and the recording mediums are ejected at the same recording-medium stacking position of the stacking tray 708 through the ejecting section and then stacked as shown in FIG. 13(*b*).

Next, the operation of the "second mode" will be described.

The document D is set in the document feeder 600 shown in FIG. 1. The job contents are set in the operating section 200B. More particularly, stapling is enabled and the copy number is designated as 2 sets in the basic setting screen 206 shown in FIG. 9. Further, offset is enabled, page offset is enabled and the second mode is selected. Page setting is enabled and "Add" is selected in the page setting screen 207 shown in FIG. 10. Further, 1 Staple is designated and the page number is designated as 3-6 pages in the page detail setting screen 207 shown in FIG. 11.

The recording-medium stacking position information recognized by the set contents of the job is notified to the controlling section 800*b* of the finisher 700, together with the other paper feeding information, at the paper feeding timing for every recording medium. The finisher 700 temporarily stores the notified paper feeding information (including the recording-medium stacking position information) in the memory M3.

When the start button not shown is pressed, the document D is read by the document reader 600 and the image formation is carried out. The first and second pages of the first group are fed into the finisher 700. They are conveyed to the process tray 706. The third to sixth pages of the first group are fed into the finisher 700, stapled by the stapler 704 and conveyed to the process tray 706. The recording-medium stacking position is recognized based on the paper feeding information which is temporarily stored in the memory M3, the matching shift 705E is controlled to match the recording-medium bundle position to the position corresponding to P1 on the process tray 706, and then the recording mediums are ejected at the recording-medium stacking position P1 on the stacking tray 708 through the ejecting section 720. Similarly, the first and second pages of the second group are fed into the finisher 700. They are conveyed to the process tray 706. The third to sixth pages of the second group are fed into the finisher 700, and stapled by the stapler 704. The stapled recording mediums are conveyed to the process tray 706. The recording-medium stacking position is recognized based on the paper feeding information which is temporarily stored in the memory M3, the matching shift 705E is controlled to match the recording-medium bundle position to the position corresponding to P2 on the process tray 706, and then the recording mediums are ejected at the recording-medium stacking position P2 of the stacking tray 708 through the ejecting section 720 and stacked as shown in FIG. 13(*c*).

Finally, the operation of the "third mode" will be described.

The document D is set in the document feeder 600 (see FIG. 1). The job contents are set in the operating section 200B. More particularly, stapling is enabled and the copy number is designated as 2 sets in the basic setting screen 206 of FIG. 9. Further, offset is enabled and the third mode is selected. Page setting is enabled and "Add" is selected in the page setting screen 207 shown in FIG. 10. 1 Staple is designated and the page number is designated as 3-6 pages in the page detail setting screen 208 shown in FIG. 11.

The recording-medium stacking position information recognized by the set contents of the job is notified to the controlling section 800*b* of the finisher 700, together with the other paper feeding information, at the paper feeding timing for every recording medium. The finisher 700 temporarily stores the notified paper feeding information (including the recording-medium stacking position information) in the memory M3.

When the start button not shown is pressed, the document D is read by the document feeder 600 and the image formation is carried out. The first and second pages of the first group are fed into the finisher 700. They are conveyed to the process tray 706. The matching position is recognized based on the paper feeding information which is temporarily stored in the memory M3, the matching shift 705E is controlled to match the recording-medium bundle position to the position corresponding to P1 on the process tray 706, and the recording mediums are ejected through the ejecting section 720 at the recording-medium stacking position P1 of the stacking tray 708. The third to sixth pages of the first group are fed into the finisher 700, stapled by the stapler 704 and conveyed to the process tray 706. The recording-medium stacking position is recognized based on the paper feeding information which is temporarily stored in the memory M3, the matching shift 705E is controlled to match the recording-medium bundle position to the position corresponding to P3 on the process tray 706, and then the recording mediums are ejected at the recording-medium stacking position P3 on the stacking tray 708 through the ejecting section 720. Similarly, the first and second pages of the second group are fed into the finisher 700. They are conveyed to the process tray 706. The recording-medium stacking position is recognized based on the paper feeding information which is temporarily stored in the memory M3, the matching shift 705E is controlled to match the recording-medium bundle position to the position corresponding to P1 on the process tray 706, and then the recording mediums are ejected at the recording-medium stacking position P1 of the stacking tray 708 through the ejecting section 720. The third to sixth pages of the second group are fed into the finisher 700 and stapled by the stapler 704. They are conveyed to the process tray 706. The recording-medium stacking position is recognized based on the paper feeding information which is temporarily stored in the memory M3, the matching shift 705E is controlled to match the recording-medium bundle position to the position corresponding to P3 on the process tray 706, and the recording mediums are ejected at the recording-medium stacking position P3 of the stacking tray 708 through the ejecting section 720 and then stacked as shown in FIG. 13(*d*).

As described above, with the image forming system of Embodiment 2, when the mixture mode is established, non-finished recording mediums and finished recording mediums within a group of recording mediums can be stacked at the same recording-medium stacking position on the staking tray, so that the recording mediums will be easily taken out all together. When the mixture mode is established, even if the offset designation is established, the non-finished recording mediums and the finished recording mediums within the group of recording mediums can be stacked at the same recording-medium stacking position on the stacking tray, so that the convenience will be improved.

In the default setting, when the mixture mode is established, offset is prohibited even if the offset designation is established, so that when further setting the output material of the whole job in an offline finisher or packing it in a box in batch, the user will not need to rearrange the output material.

Further, when "offset in the mixture mode" is selected and established in the offset control setting screen in the mixture mode, offset by group and offset by sub-group are allowed even in the mixture mode. Thus, the recording medium bundle can be offset for every user or every job with a separation reflecting the user's intention, so that the convenience can be improved.

Incidentally, the recognitions of the first recognition section, second recognition section and third recognition section allow the simple and reliable control of the recognition of the recording-medium stacking positions. With the image forming apparatus, it will be possible to achieve the above described advantage by combining with the finisher. Further, with the program, a program capable of controlling the image forming system will be realized, and in particular, when the mixture mode is established, the image forming system will be controllable so that the non-finished recoding mediums and the finished recording mediums within the group are stacked at the same recording-medium stacking position on the stacking tray.

It is to be understood that Embodiments 1 and 2 were described above, but the invention is not limited to these embodiments, and for example, although the recording-medium stacking position is changed by shifting the recording mediums using the matching shift section of the finisher in the embodiments, the recording-medium stacking position may be changed by shifting the stacking tray itself. The recognition of the boundary of groups may be made by recognizing whether the recording medium is the first recording medium of the second or later group, or by recognizing whether the recording medium is the last recording medium of the group. As for the finish processing for recording mediums, a processing applied to the recording mediums is preferred, and particularly, the finish processing that performs stapling, punching or folding is effectively applied to the embodiments. The mixture mode was described by taking a typical example of the case in which plural non-stapled recording mediums and one stapled bundle are intermingled within the single group, but for example, plural stapled bundles may exist within a single group. Further, Embodiment 1 was described by taking an example of the case in which when the mixture mode is established, the non-finished recording mediums and the finished recoding mediums within the group are stacked at the same recording-medium stacking position on the stacking tray, and the recording-medium stacking position is shifted to two places in the front side and the back side as seen from the front of the image forming system, but for example, the recording-medium stacking position may be switched to three or more places.

According to the above embodiments, the following effects can be attained.

Since the non-finished recording medium and the finished recording medium within the single group are stacked at the same recording-medium stacking position on the stacking tray if the mixture mode is set, it becomes possible to easily take out the recording mediums of a group, even if the mixture mode is set.

It becomes possible to change the recording-medium stacking position for every group of recording mediums too. Accordingly, it is possible to easily recognize each boundary of the group, even if the mixture mode is established.

It becomes possible to set the recording-medium stacking positions of the plural groups of all printing materials at the same position within the stacking tray. Accordingly, it becomes possible to easily take out the plural groups as a single unity, and to easily pack them into a box after taking out them from the stacking tray.

Even if the mixture mode is set, it becomes possible to select any one of the first mode, the second mode and the third mode depending on the usage, resulting in an improvement of usability.

While the mixture mode is set, the non-finished recording medium and the finished recording medium in the same group can be stacked at a same recording-medium stacking position within the stacking tray, even if a change command of the recording-medium stacking position is set. Accordingly, it is possible to simplify the taking-out operation, even if the recording-medium stacking position is already set irrespective of the user's intention.

It becomes possible to surely control the recording-medium stacking position, simply based on the recognition results outputted by both the first recognition section and the second recognition section.

It becomes possible to surely control the recording-medium stacking position, simply based on the recognition result of the first recognition section, the recognition result of the second recognition section and the recognition result of the third recognition section.

If handling recording mediums, which are ejected from the image forming apparatus and to which various kinds of processing, such as a staple processing, a punching processing, etc., are to be applied, the present embodiments can be more effectively implemented.

Since a number of the plural groups corresponds to a number of sets of the plural printing materials to be produced from the single document set, the abovementioned effects are exhibited within this number of the plural printing materials.

While the preferred embodiments of the present invention have been described using specific term, such description id for illustrative purpose only, and it is to be understood that changes and variations may be made without departing from the spirit and scope of the appended claims.

What is claimed is:

1. An image forming system, comprising:

an image forming apparatus to produce at least one bunch of recording mediums from a single set of document mediums; and a finisher to selectively apply a finish processing to one or more of the recording mediums in each said bunch of recording mediums, the finisher being operable in a first finishing mode, a second finishing mode, and a mixture mode, such that (i) in the first finishing mode, each said bunch of recording mediums comprises all finished recording mediums to which the finish processing has been applied, (ii) in the second finishing mode, each said bunch of recording mediums comprises all non-finished recording mediums to which the finish processing has not been applied, and (iii) in the mixture mode, each said bunch of recording mediums comprises a mixture of finished recording mediums and non-finished recording mediums;

wherein the finisher comprises:

a stacking tray to stack the at least one bunch of recording mediums; and a matching shift section to match and shift the finished recording mediums or the non-finished recording mediums in a direction orthogonal to an ejecting direction of the recording mediums, before the recording mediums are ejected onto the stacking tray; and wherein, when the image forming system produces the at least one bunch of recording mediums in the mixture mode in which each said bunch of recording mediums includes the finished recording mediums and the non-finished recording mediums intermingled within the bunch of recording mediums, the matching shift section is controlled so that the finished recording mediums and the non-finished recording mediums, both to be intermingled within the bunch of recording mediums, are stacked at a same recording-medium stacking position on the stacking tray.

2. The image forming system of claim 1, wherein, when the image forming system produces a plurality of the bunches of recording mediums, the matching shift section is controlled so as to change the recording-medium stacking position for each bunch of recording mediums.

3. The image forming system of claim 1, wherein, when the image forming system produces a plurality of the bunches of recording mediums in the mixture mode, established in advance, from the single bunch of document mediums, the matching shift section is controlled so that the recording-medium stacking positions of the plural bunches of recording mediums on the stacking tray are the same.

4. The image forming system of claim 1, wherein an operating mode of the image forming system can be selectively set in any one of:

a first stacking mode in which, when the image forming system produces a plurality of the bunches of recording mediums, the recording-medium stacking positions of the bunches are set at a same position on the stacking tray, when the mixture mode is established;

a second stacking mode in which, when the image forming system produces a plurality of the bunches of recording mediums, the non-finished recording mediums and the finished recording mediums within a same bunch are stacked at a same recording-medium stacking position on the stacking tray, and the recording-medium stacking position is changed for each bunch of recording mediums, when the mixture mode is established; and a third stacking mode in which the recording-medium stacking position is changeable within the same bunch of recording mediums, even when the mixture mode is established.

5. The image forming system of claim 1, wherein, when the mixture mode is established, the image forming system is controlled such that the non-finished recording mediums and the finished recording mediums within each said bunch are stacked at the same recording-medium stacking position on the stacking tray, even if a setting for changing the recording-medium stacking position is established.

6. The image forming system of claim 1, wherein the image forming apparatus or the finisher includes:

a first recognition section to recognize whether or not the mixture mode is currently established; and a second recognition section to recognize, when the image forming system produces a plurality of the bunches of recording mediums, whether or not a stacking changeover from one of the bunches of recording mediums to a next one of the bunches of recording mediums is currently detected; and wherein the matching shift section is controlled so as to change the recording-medium stacking position based on recognition results outputted by both the first recognition section and the second recognition section.

7. The image forming system of claim 6, wherein, when the first recognition section recognizes that the mixture mode is currently established and the second recognition section recognizes that the stacking changeover is not currently detected, the matching shift section is controlled so as not to change the recording-medium stacking position; and wherein, when the first recognition section recognizes that the mixture mode is currently established and the second recognition section recognizes that the stacking changeover is currently detected, the matching shift section is controlled so as to change the recording-medium stacking position.

8. The image forming system of claim 6, wherein either the image forming apparatus or the finisher includes a third recognition section to recognize whether or not another stacking changeover from a job to a next job is currently detected; and wherein the matching shift section is controlled so as to change the recording-medium stacking position based on recognition results outputted by the first recognition section, the second recognition section, and the third recognition section.

9. The image forming system of claim 1, wherein the finish processing is a physical processing applied to recording mediums outputted from the image forming apparatus.

10. The image forming system of claim 1, wherein the image forming system produces a number of the bunches of recording mediums that is equal to a number of copies to be produced from the single set of document mediums.

* * * * *